US005839853A

United States Patent [19]

Oppenheimer et al.

[11] Patent Number: 5,839,853

[45] Date of Patent: Nov. 24, 1998

[54] BUOYANT MATTER DIVERTING SYSTEM

[76] Inventors: M. Leonard Oppenheimer, 8308 Marcie Dr., Pikesville, Md. 21208; W. Selden Saunders, 223 Hopkins Rd., Baltimore, Md. 21212

[21] Appl. No.: 470,810

[22] Filed: Jun. 6, 1995

Related U.S. Application Data

[63] Continuation-in-part of Ser. No. 770,116, Oct. 2, 1991, Pat. No. 5,478,167.

[51] Int. Cl.[6] ..... E02B 15/04

[52] U.S. Cl. ..... 405/60; 405/80; 405/74

[58] Field of Search ..... 405/15, 25, 60, 405/80, 74; 366/343, 265

[56] References Cited

U.S. PATENT DOCUMENTS

| | | | |
|---|---|---|---|
| 3,830,066 | 8/1974 | Larsen . | |
| 4,141,318 | 2/1979 | Mac Vane et al. | 119/3 |
| 4,394,268 | 7/1983 | Reid | 210/628 |
| 4,560,304 | 12/1985 | Jenkins et al. . | |
| 4,661,013 | 4/1987 | Jenkins . | |
| 4,717,286 | 1/1988 | Loer . | |
| 4,813,377 | 3/1989 | Riché | 119/3 |
| 5,149,195 | 9/1992 | Löfgren | 366/343 |
| 5,456,596 | 10/1995 | Gourdine | 431/9 |

*Primary Examiner*—Frank Tsay
*Attorney, Agent, or Firm*—Max Stul Oppenheimer

[57] ABSTRACT

A system of structures uses the energy and properties of a stream flow to protect downstream structures from various potentailly damaging stream-flow-induced events. One element, a streamwise-vortex generator is placed upstream from a structure to protect it from impact by buoyant contaminates. The generator is positioned at a depth sufficiently below the surface to minimize the likelihood of contact with vehicles or debris. In this position it induces a vortex in the current flow whose axis is essentailly parallel to the streamwise flow. The vortex persists downstream of the generator and, migrating to the surface, deflects a debris away from the protected structure. Another element, a vorticity generator, causes interference with, and/or diversion of streambed-scouring vortices or eddies which are naturally generated adjacent the sides of structures. The result is protection of the streambed from damaging scour which would otherwise occur. A third element, a drag generator, is sited upstream from a structure to protect it from the damaging results of scour by significantly mitigating or eliminating the scour. The generator is positioned above the streambed so that it, along with the wake it produces, acts to reduce scour and/or contraction scour. Mounting and/or anchoring systems are also disclosed.

14 Claims, 34 Drawing Sheets

A - A f - f

A - A

A - A

BUOYANT MATTER DIVERTING SYSTEM

This is a continuation-in-part of U.S. application Ser. No. 07/770,116, filed Oct. 2, 1991. Now U.S. Pat. No. 5,478,167.

FIELD AND BACKGROUND OF THE INVENTION

Field of the Invention

The invention relates in general to the protection of structures in fluids, and more particularly to devices installed in a stream flow upstream of or directly on structures to protect the structures from damaging impact of buoyant contaminants or scour-induced damage or failure.

BACKGROUND OF THE INVENTION

Definitions

In describing the invention, it will be helpful to set forth the definitions of certain terms used herein.

"Array" is defined as a plurality of devices so positioned as to extend, reinforce and/or otherwise enhance the effectiveness of a single device or another array of said devices.

"Contaminant" is defined as any material, substance or object carried in or on a fluid other than the fluid itself. A "contaminant" is defined as "buoyant" if it displaces a weight of said fluid equal to or greater than its own weight.

"Downstream" and "Upstream" are defined with respect to the direction of the flow in the relevant portion of the stream.

"Scour" is defined as the removal of material of a streambed by the action of stream currents and/or anomalous flows induced by whatever means. Several types of scour are known in the art. Examples are "local scour," "wake scour," and "contraction scour."

"Stream" and its variants are defined to include any fluid, whether normally flowing or flowing only by virtue of intermittent activity such as tidal variations, pumping or during flooding.

"Streamwise vortex" is defined as a flow which follows a helical pattern of progressively expanding radius about a central axis, which axis is aligned with the general direction of the stream flow.

"Structures" is intended to include man-made as well as naturally occurring objects such as, but not limited to, piers, debris, glaciers, islands and banks.

"Vortex-pair" is defined as any pair of counter-rotating vortices.

"Vorticity" is defined as the curl of the velocity field and is a measure of local rotation of the fluid.

Background

Conventional techniques for protection of structures in streams focus on prevention or mitigation of impact damage and scour.

Prior art techniques for preventing impact damage to a structure function by increasing the structure's clearance above the normal water surface, increasing the space between support structures and streamlining the support structures in an attempt to minimize the damage when impact does occur.

The prior art also teaches the use of debris arresters or deflectors, constructed of one or more vertical pilings, or bundles of pilings, driven into a river bed upstream of a structure to divert ice, logs and other debris from impacting the structure.

These deflectors, or pilings, are of limited effectiveness because they can cause a vertically eddying flow and do not accommodate shifting of the angle of attack of the stream flow.

The debris may return to its original course with the same potential of impacting the structure. Vertically eddying flow may cause certain types of debris, such as broken branches to become entangled with the piling thereby accumulating additional debris. If the expanded accumulation of debris breaks loose, its increased size presents a greater likelihood of impact with resultant greater damage than if there had been no barrier at all.

Further, the conventional barrier affects the stream flow primarily in the immediate region of its location. A rotary motion about a vertical axis is imparted to logs or other debris of elongated-shape, resulting in the possibility of more severe damage than had the barrier not been installed.

Reference is made to U.S. Pat. No. 4,560,304, issued December, 1985 to Jenkins and Sparks for "Method and Apparatus for Impeding Sediment Deposition in Harbors and Navigational Channels", and U.S. Pat. No. 4,661,013, issued April, 1987 to Jenkins for "Apparatus for Impeding Fine Sediment Deposition in Harbors and Navigational Channels", both of which teach the use of vortices in water. It should be noted that these inventions teach the use of negative downwash only. Negative downwash is generated by devices situated close to the bottom of a waterway with the purpose of maintaining an agitated condition of otherwise immobile silt in order to minimize the settling thereof and allowing the stream current to carry it downstream. Streamwise vortices are mentioned, but their use is limited to increasing the mixing of the disturbed silt. Since the vortices rolling off the ends of a single Jenkins device would operate to redeposit the agitated material immediately outside the negative downwash produced by the device, Jenkins employs wings in tightly packed arrays. This is in contrast to our invention wherein the devices are positioned to cause the generated vortices to divert buoyant contaminants from a protected downstream structure. Silt is, by definition, not a buoyant contaminant.

Jenkins teaches deflection of silt in the direction of the downwash. To simulate the function of our invention it would be necessary for Jenkins' device to rotate 90° about its central chord, and allow one end to protrude above the stream surface. It would require two of Jenkins' devices, sited one on each side of the structure to be protected. Jenkins does not teach the upstream deployment of means to protect downstream structures. Scour near structure supports compromises the integrity of the streambed which, in turn, compromises the integrity of the structure's support. An unusual event, such as a flood, or accidental water-vehicle impact may result in the catastrophic loss of a structure.

Conventional methods to protect against scour include:

1. Making piers thin and spans between piers long, in order to reduce contraction scour; this compromises the bridge structure and tends to increase its cost.

2. Use of rip-rap (a layer of rocks)around the base of a pier, to armor the bed and control erosion; this is costly and the rip-rap itself is susceptible to scour.

3. Use of a cabled- or chained- block blanket surrounding the base of a pier; this is more expensive than rip-rap and difficult to install.

4. Use of a fixed collar around the base of the pier to protect the bed from the vortices which cause the "horseshoe" local scour; this is expensive to install and must be installed on each structure being protected. U.S. Pat. No.

4,717,286, issued Jan. 5, 1988 to Loer for "Anti-Scour Apparatus and Method", teaches the use of a double collar consisting of a lower perforated portion and an upper portion surrounding a pier.

5. Another approach to influencing live bed scour is taught by U.S. Pat. No. 3,830,066, issued to Larsen Aug. 20, 1974, for "Apparatus and System for Producing and Protecting Deposits of Sedimentary Material on Floors of Bodies of Water." This method provides a "flexible preferably mesh material sheet which is located beneath the surface of the water." "As waves, currents or the like pass by . . . turbulence of the water is minimized beneath the sheet whereby undermining due to water motion is precluded and sedimentary deposition is assured." Such devices would only have local effect and could not be deployed upstream of the structure being protected.

SUMMARY OF THE INVENTION

The foregoing disadvantages of existing systems are overcome by the present invention which uses of a system of devices designed to use only the energy and properties of a stream to protect structures in the stream.

In one element of the system, a device generating one or more streamwise vortices is sited upstream from a structure to protect the structure from impact of buoyant contaminants. The novel device is positioned at a depth below the surface to minimize the likelihood of contact with vehicles or debris. It is oriented at an attitude which causes the streamwise vortices to migrate to the surface where the energy in the horizontal velocity component, at or near the surface, guides buoyant contaminants from impacting the protected structure. Using only the stream's energy and few, if any, moving parts results in a cheap and virtually maintenance-free installation. Similar devices may be attached directly to the protected structure in such fashion as to interfere with or divert naturally-occurring vortices or turbulent eddies which would otherwise cause damaging scour adjacent the structure.

Another element of the system, a streamwise-energy-utilizing device comprising a drag generating body, is placed upstream from a structure to protect the structure from the damaging results of scour by significantly mitigating or eliminating the scour. The device is positioned a distance above the streambed so that the device, along with the wake it produces, acts to reduce local scour and/or contraction scour without adversely affecting the streambed.

These elements can be combined into a system for protecting structures based on site-specific considerations.

Among the objects of the invention are:

1. To provide a system of novel devices which modify the flow of a stream, using the energy and characteristics of a stream flow to protect structures in the stream.

2. To mitigate or eliminate the hazard of damage to downstream structures due to impact and abrasion from buoyant debris.

3. To accomplish its other objects while reducing the hazard of collision of water vehicles with the system or the structures being protected.

4. To control a specific case of buoyant debris, surface ice, so as to reduce that hazard to downstream structures.

5. To control a second specific case of buoyant debris, entrained oxygen so as to enhance oxygenation of a stream.

6. To provide such a system which is self-adjustable in response to changing environmental conditions.

7. Another object is to provide a means of enhancing transfer of heat into surrounding medium from, for example, dissipating heated effluent of power plant coolant.

8. Another object of the invention is to provide a drag-producing element which significantly mitigates or eliminates scour downstream of the element.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

Although the invention has utility for fluids generally, it can be described with reference to the particular case of protecting a bridge spanning a stream.

EXAMPLE 1: PROTECTION OF STRUCTURE FROM IMPACT DAMAGE

Figure 1:
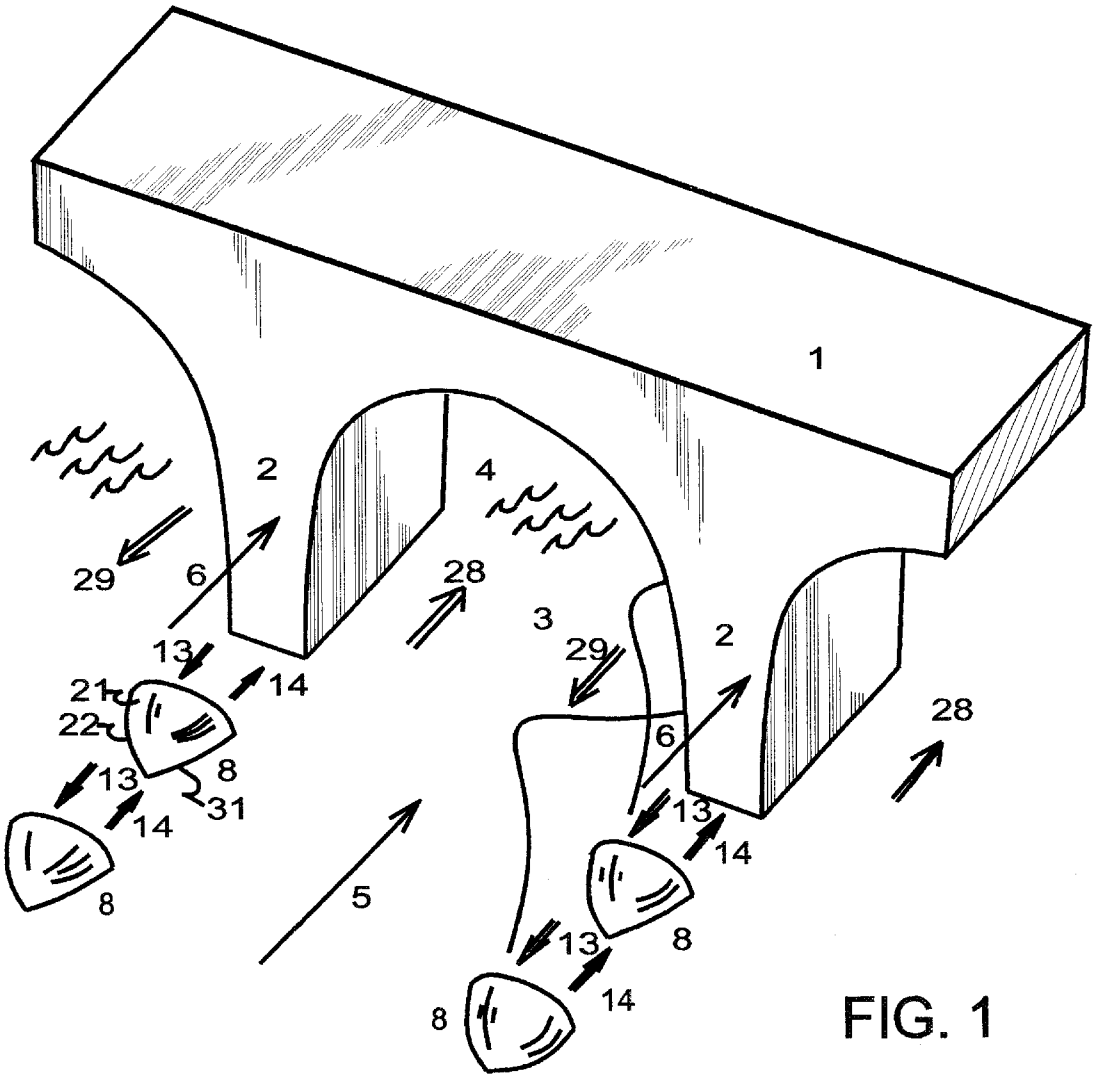
FIG. 1 is a perspective view of a bridge with the novel vortex-generators shown in a stream.
Figure 2:
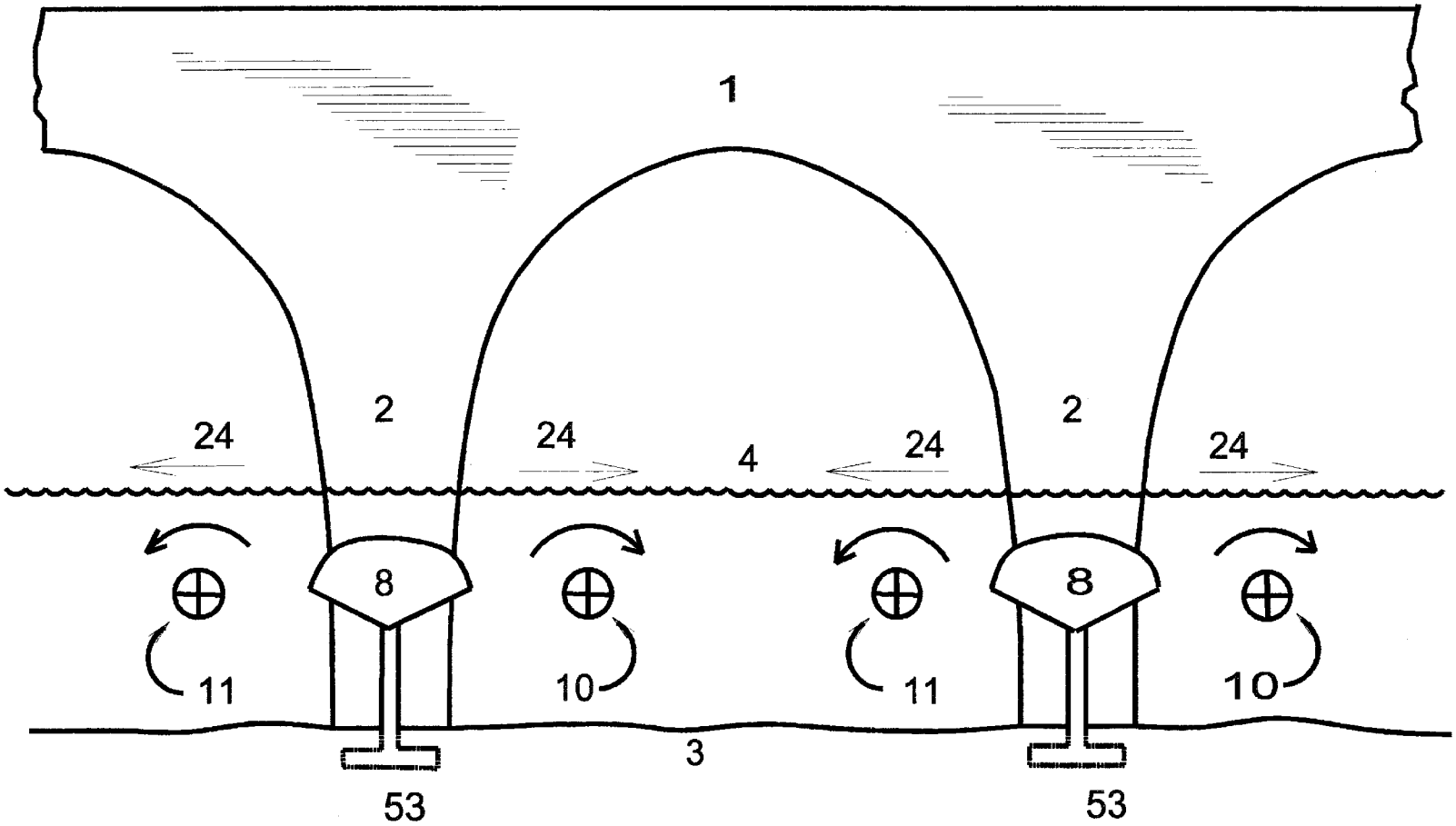
FIG. 2 is a front elevation of FIG. 1.
Figure 3:
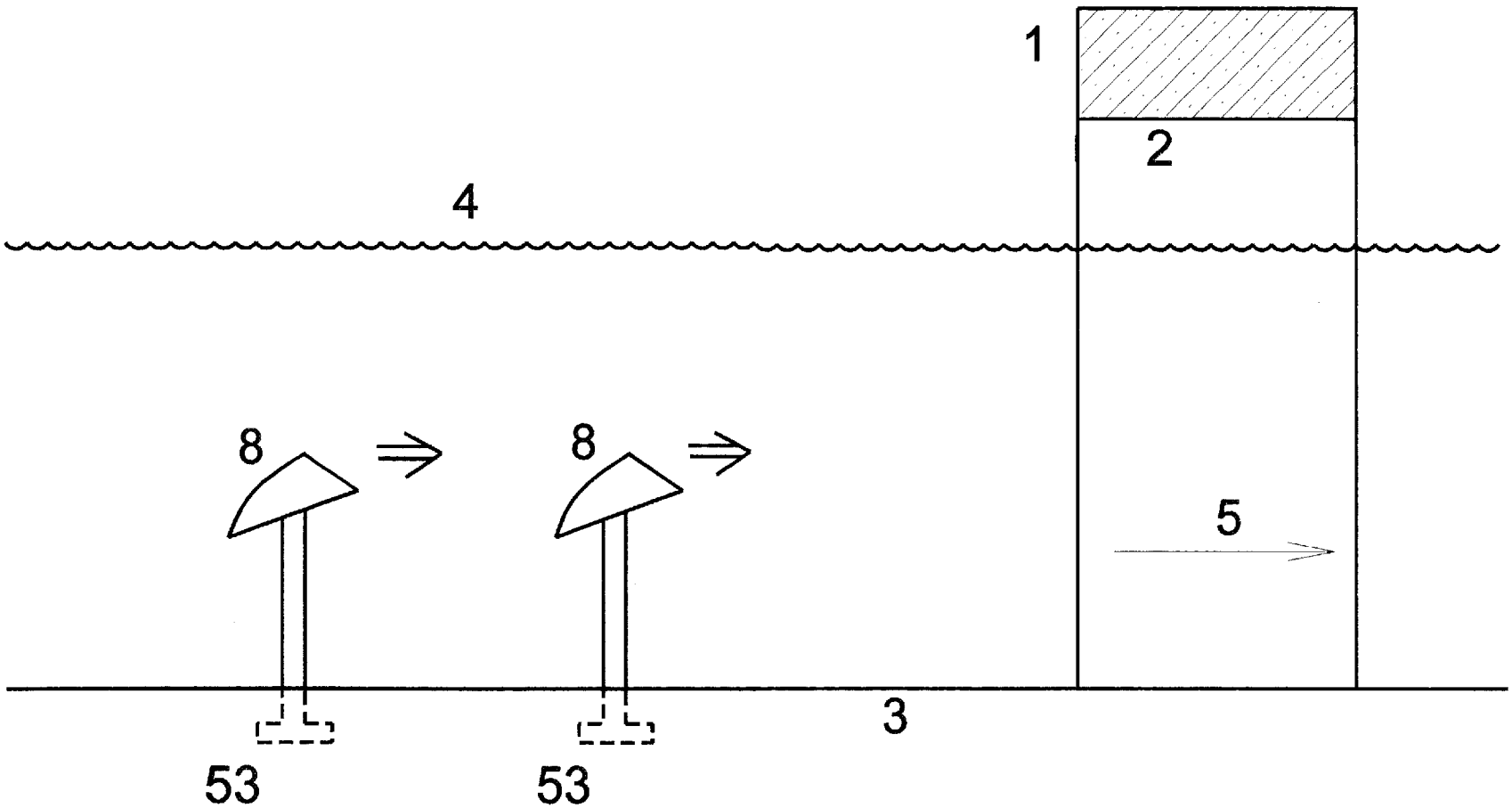
FIG. 3 is a profile of FIG. 1.

FIGS. 1, 2 and 3 show perspective, front elevation, and profile views of a bridge (1) supported by piers (2) in a stream. The stream bed is indicated by (3) and the water surface by (4). The stream flow (5) is in the direction of the arrow at 5. Lines 6, parallel to the direction of stream flow (5), indicate the centerlines passing through novel double streamwise vortex generators ("DSVG") (8) and each respectively associated pier (2). Buoyant debris approaching the bridge along lines 6 would ordinarily impact the piers (2) resulting in damage.

The DSVG generators (8) include hydrodynamically active surfaces, which generate a rotation, or vortex, of the flowing fluid about an axis parallel to the direction of the stream flow 5.

Figure 5A:
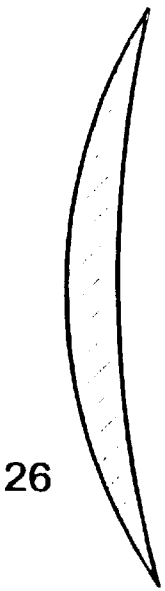
FIG. 5 shows plan and section views of a Double Streamwise Vortex Generator (DSVG).
Figure 5:
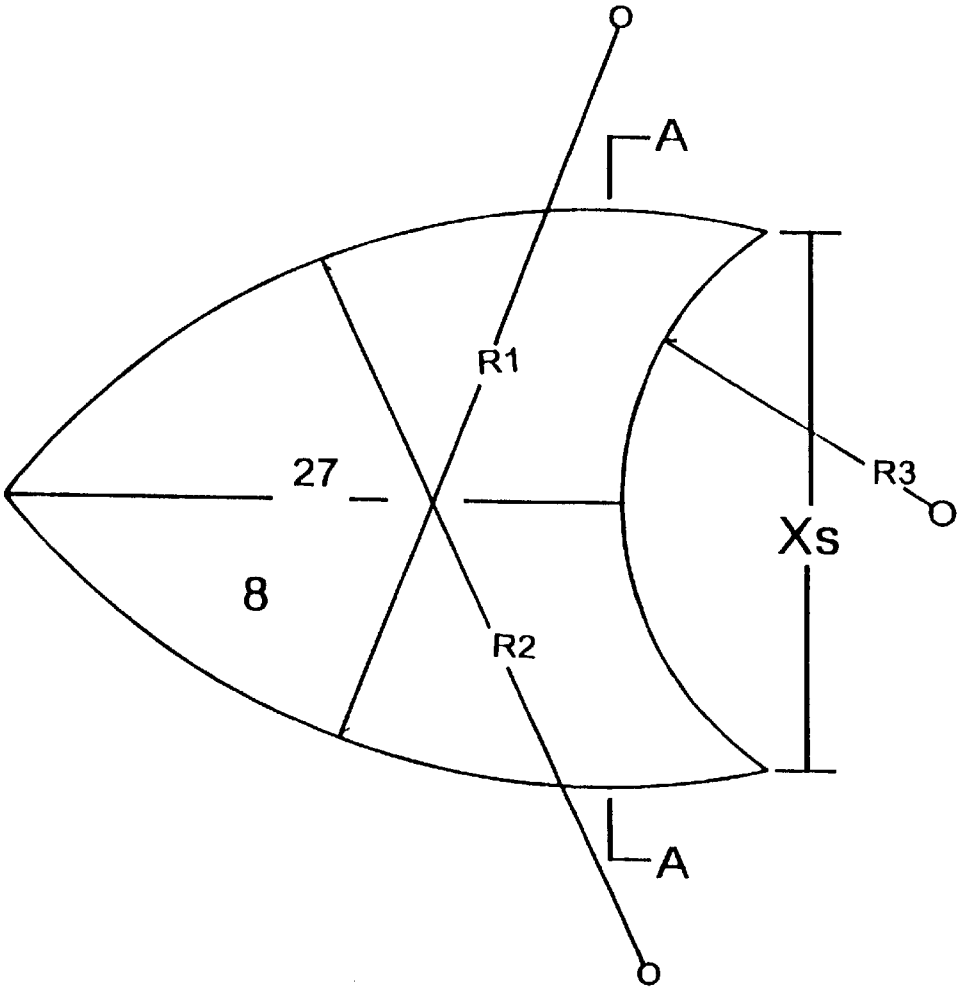

The DSVG is configured to generate counter-rotating streamwise vortices. FIG. 5 depicts a preferred configuration for doing so. The DSVG (8) has arcuate cross-section, and is defined by the three indicated arcs (R1, R2 and R3), resulting in a length to width ratio of approximately 4:3. Preferably, arcs R1 and R2 have the same radius and length.

Figure 7A:
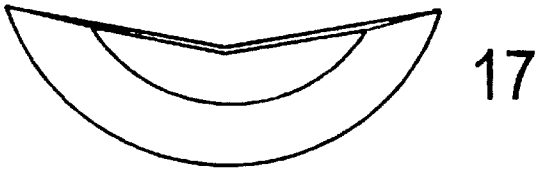
FIG. 7 illustrates the method of forming a DSVG.
Figure 7B:
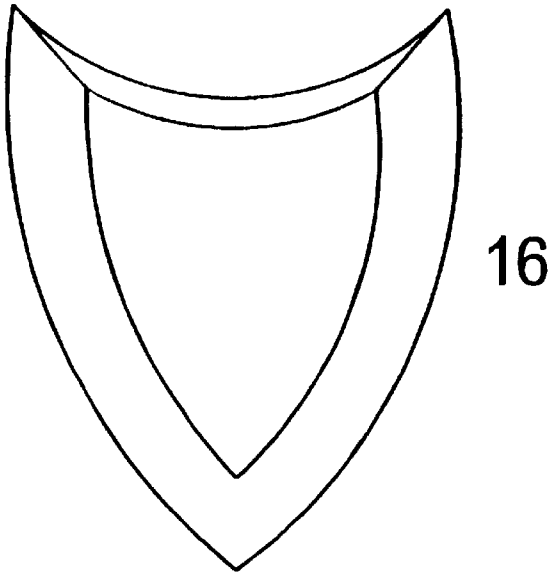
Figure 7:
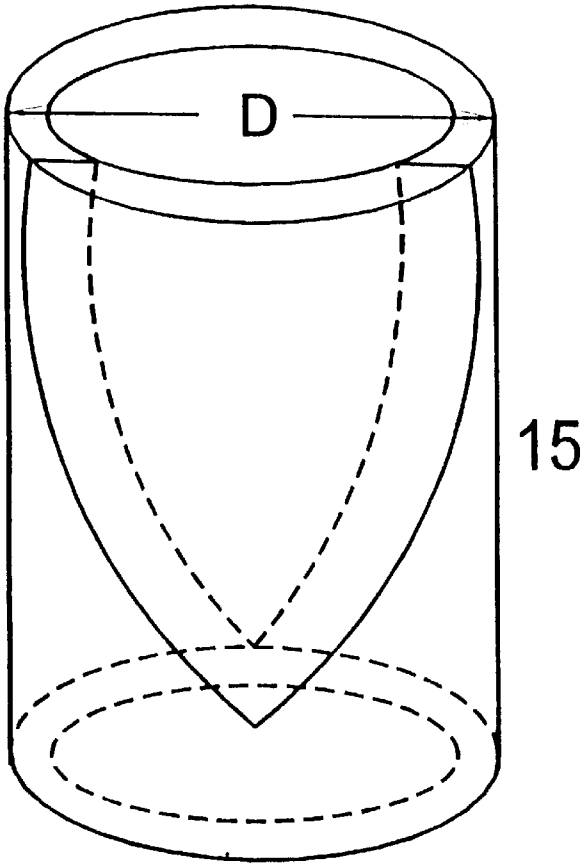

FIG. 7 illustrates a simple method of producing a DSVG. A hollow cylindrical tube (15) is cut at an angle; two arcs (R1 and R2) are thereby generated from the sides of the tube, and a third arc (R3) is generated from an end of the tube . The form resulting from this is shown in rear view (17). The rearward end is rendered arcuate, resulting in shape (16), which is a suitable DSVG. The resultant surface configuration of the modified removed section may be defined as being delineated by three arcs (R1, R2 and R3) as shown in FIG. 5.

Figures 6, 6A:
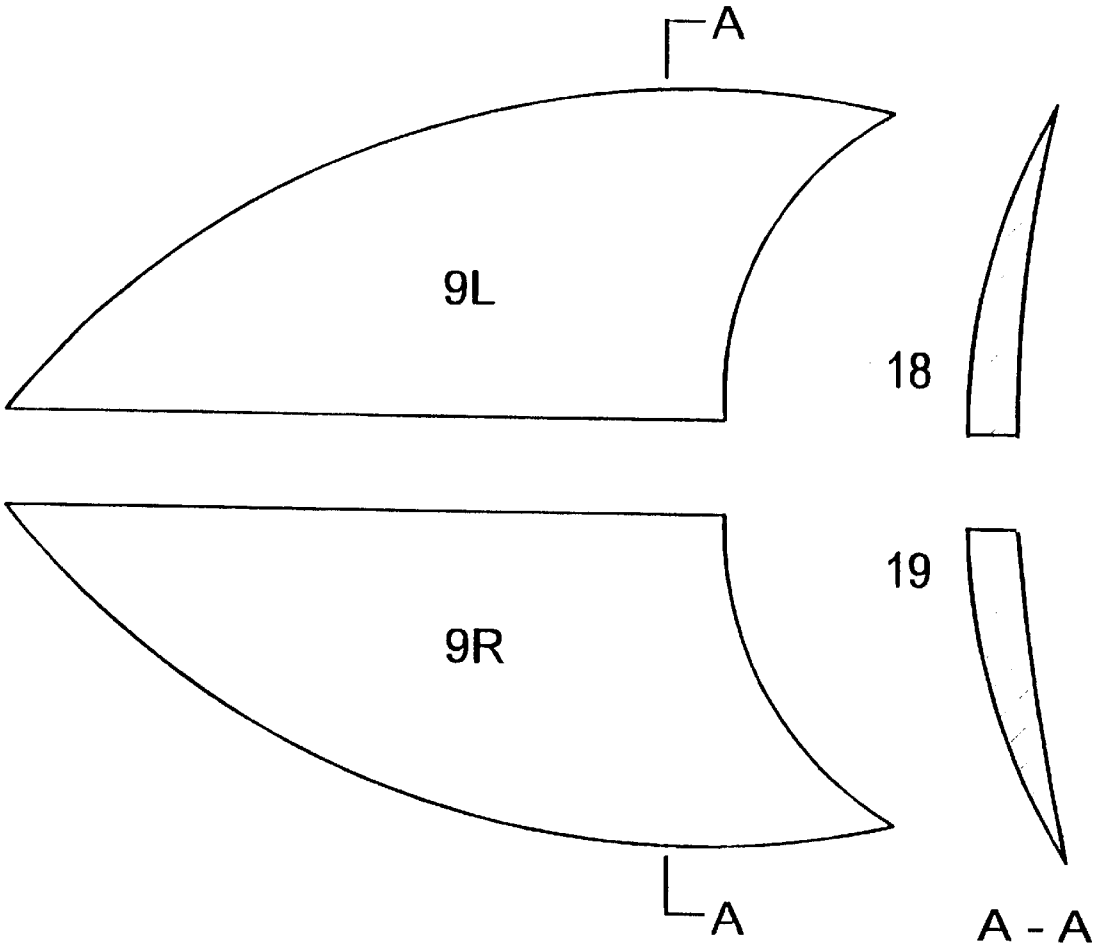
FIG. 6 shows plan and section views of a Single Streamwise Vortex Generator (SSVG).

The invention will be further described in its preferred DSVG embodiment. Factors, such as space constraints, may, however, prevent the use of a DSVG. In that case, a single streamwise vortex generator may prove effective. FIG. 6 illustrates a preferred configuration when only a single vortex is required, or mounting constraints obtain. The single streamwise vortex generator (SSVG) is constructed as either of two mirror-image shapes (9), the selection of which being dictated by the direction of rotation of the vortex the generator is required to produce, resulting when DSVG (8) is bisected along its length (27) drawn from the forward intersect of the two side-defining arcs (R1 and R2) and the center used to define the third (rearward) arc (R3). The operation of the invention is the same for DSVG and SSVG, except for the need to select the SSVG of appropriate direction, and an SSVG may be substituted for DSVG in the discussion below without departing from the invention.

DSVGs (8) are placed upstream of the bridge, and disposed more or less along lines 6, so as to generate counter-rotating vortices (13 and 14). The sense of rotation is conveniently described by the Right-hand Rule: using the right hand with the thumb pointing downstream, rotation in the direction in which the fingers point is identified as positive rotation and is denoted by a double arrow pointing downstream. Rotation opposite that direction is identified as negative rotation and is denoted by a double arrow pointing upstream.

Using this convention the vortices (13 and l4) generated by the DSVGs (8) are denoted by double arrows.

Referring again to FIG. 1, DSVG (8) has upper surface (21) which is inclined upwardly, and a first edge (22) and second edge (31). Flow contacting upper surface (21) is upwardly deflected. This results in negative vorticity shed from first edge (22) and rolling up into left-hand streamwise vortex (13). Second edge (31) of DSVG (8) sheds its vorticity in a positive sense resulting in right-hand streamwise vortex (14).

The DSVG (8) is shown as anchored by a bottom portion in the stream bed (3). Note that for the novel generators to produce the desired effect it is not necessary for any portion of them to be near the surface of the water (4). They may be positioned so that they do not present a hazard to navigation and are not normally liable to be impacted by debris. The generators must be placed, with respect to the surface of the stream, so as to generate streamwise vortices which affect the path of buoyant contaminants in the area to be protected.

The vortices persist downstream and, throughout the region influenced by the vortices, debris is deflected from the path (6) which it otherwise would have followed to impact with pier (2). The debris is thereby guided away from impact and passes downstream.

The same principle applies to any structure it is desired to protect. Piers are used as a readily perceived illustrative example.

Considering FIG. 1 and FIG. 2 together, it can be seen that each DSVG (8) creates a vortex-pair (13 and 14). Left-hand streamwise vortex 13 deflects buoyant debris in one direction (24) while on the other side of DSVG (8) right-hand streamwise vortex (14) deflects debris in the opposite direction (24). The effect can be reinforced by another DSVG (8), of the same general design also disposed along line 6. The additional DSVG (8) produces vortices in the same fashion enhancing the effect of the vortices generated by the first DSVG. It should be noted that vortices of the same sign and in the same line may amalgamate into a more energetic single streamwise vortex.

Where site-specific parameters make it desirable to influence a greater area the generators may be tethered in such a manner as to permit a controlled amount of flow-induced lateral oscillation.

The effectiveness of the generator is uninfluenced by the depth of the water at the site. Streamwise vortices generated by the properly sited vortex generators will migrate upward and in the respective directions indicated by 24, passing downstream on both sides of the piers (2).

A pier may be protected against debris impact by a single DSVG or by a single line of such generators.

Figure 12:
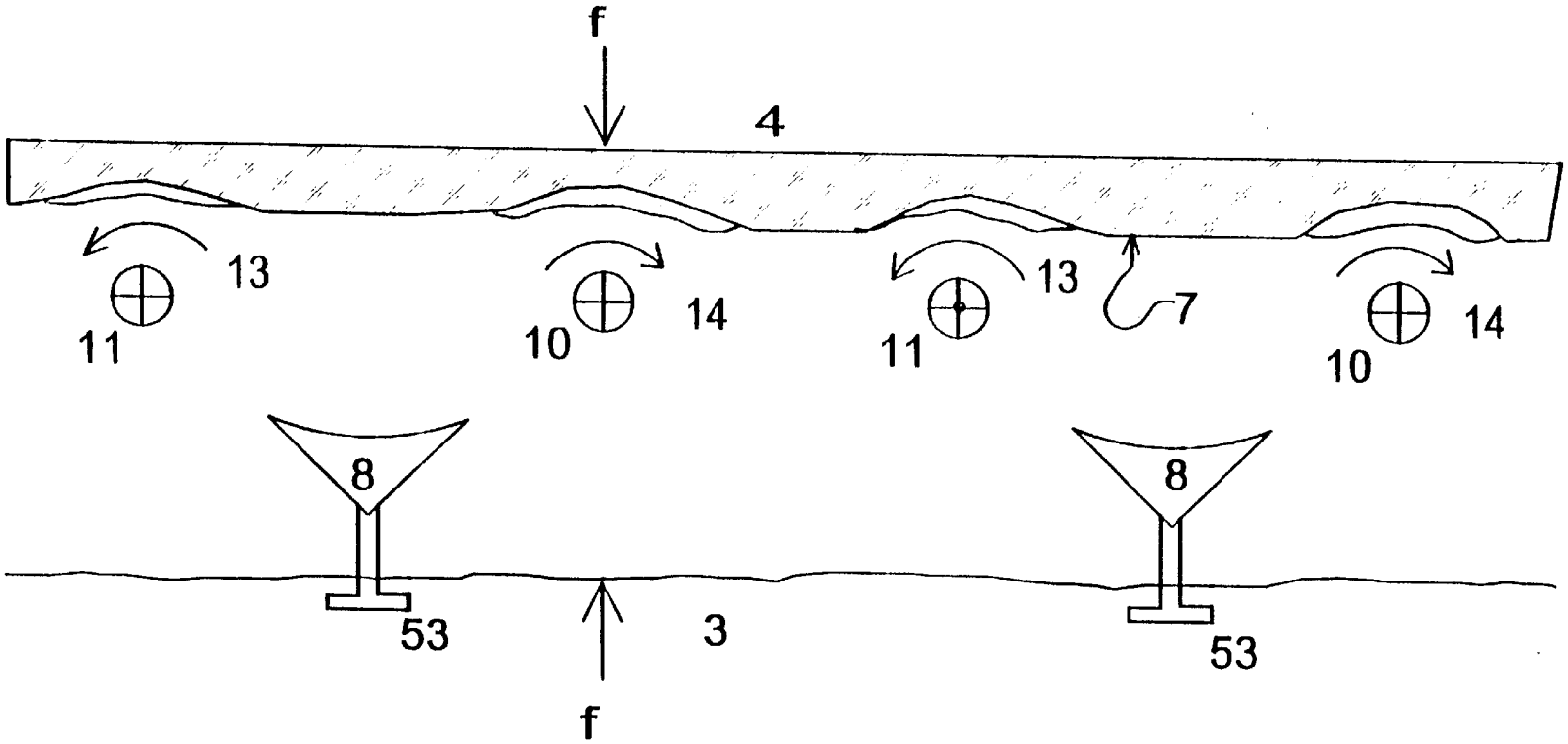
FIG. 12 is a streamwise view illustrating the effect of streamwise vortices on the formation of surface ice in the area protected by the generators.
Figure 13:
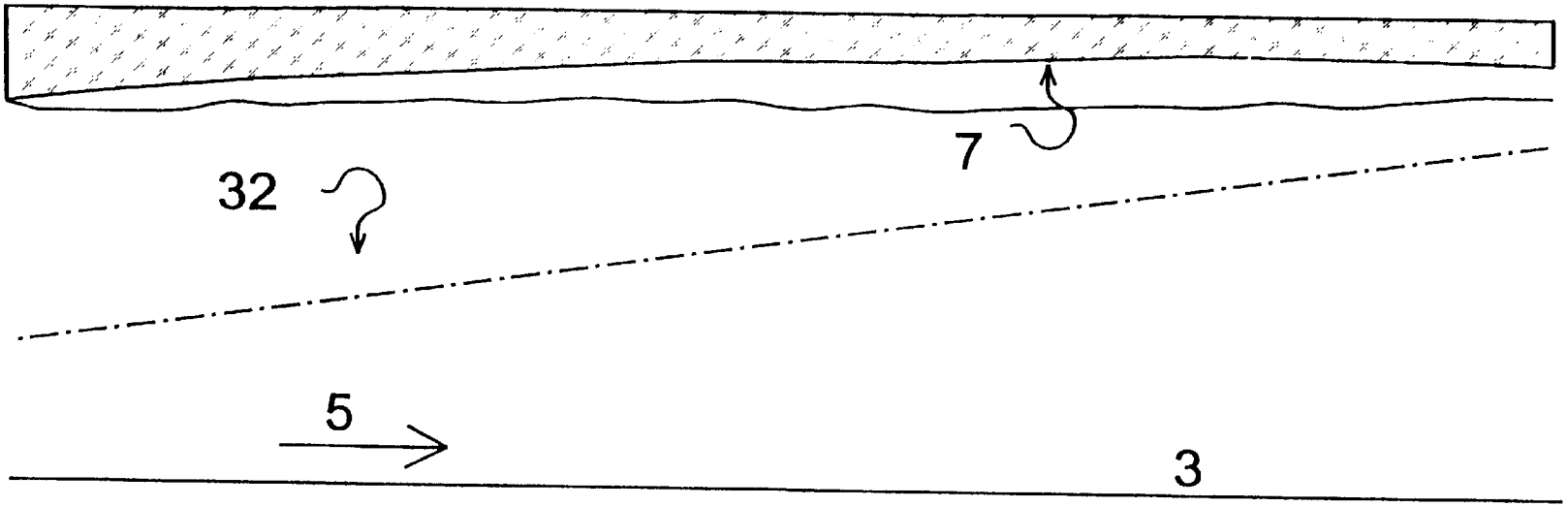
FIG. 13 is a cross-stream view taken at section f—f of FIG. 12.

Floating ice is merely a special case of debris, and will be deflected away from piers (2) in the same fashion as other debris. However, an additional benefit is derived from the instant invention under freezing conditions. The streamwise vortices generated will affect surface freezing in the area protected by the generators thereby mitigating the damage attendant the formation of ice on and around such structures. The generators may be placed in the current upstream of a location where it is desired to influence the formation of surface ice so as to forestall, or modify, a buildup of ice-pack. If extremely low air temperatures cause formation of ice solidly across the water surface, the thickness of the ice at the upper extremes of the generated vortex radius will be less than the thickness in the areas unaffected by, or less affected by the action of the vortex. These areas of reduced thickness will respond to the stress of movement more readily than the thicker areas, influencing the breakup of the ice. The effectiveness of the vortex is influenced by the distance from the center of the vortex taken in a direction perpendicular to the stream surface. This phenomenon results in a more predictable and more controllable breakup of the surface ice. This is illustrated in FIG. 12 and FIG. 13 which are schematic front and side elevations of DSVG (8) operating beneath ice cover (7). The upward migration of the vortex is indicated by (32).

The influence of a streamwise vortex on surface ice formation is illustrated in FIG. 12. DSVG (8) produces a pair of counter-rotating vortices (13 and 14). Each vortex creates a flow which continually rotates water from the lower strata to the surface. A portion of the energy in the vortex is dissipated, normally, at or close to the surface. The release of this additional energy influences the thickness of the ice along a line coinciding with the path of the vortex's downstream progress. Breakup of the ice cover is facilitated along these fault lines.

The generators may be employed to modify erosion patterns in littoral areas by generating a desired current, modifying an existing current or generating an intervening flow to affect an undesirable current.

Oil slicks and oxygen are two additional examples of buoyant debris which illustrate the wide use of the invention.

The generators may be placed to divert oil slicks in the same manner as diversion of floating debris such as logs, by generating a flow between an area to be protected and an approaching oil slick, retarding the flow of the oil to the protected area and/or diverting it to an area which may provide easier recovery Likewise, streamwise vortices will enhance oxygenation by rotating lower water strata to the surface, causing a larger volume to be exposed to the air than would be exposed by the normal current and subsequently mixing it with the lower strata. This enhanced oxygenation of the water promotes a more robust aquatic ecosystem without requiring the use of any power other than the energy of the moving water, and the absence of any machinery or moving parts results in the virtual absence of maintenance.

Another application of the generator is its employment in cooling and aeration ponds. The generator, mounted on a rotating boom, and/or positioned in the effluent stream will enhance the aeration and cooling of the contents of the pond by the same mechanism as oxygenation—greater mixing and exposure of warm elements to cooler elements, such as air.

The present invention, properly configured, would provide beneficial utility in the handling of effluent from power plants which take coolant water from a body of water and return the heated water to the same body of water. The devices, positioned at or near the effluent discharge, directly in the discharge stream, would generate vortices which would increase the rate of heat exchange by exposing the heated effluent more rapidly to the surrounding water as well as to the air. The vortices also propel the heated effluent a greater distance from the discharge point distributing the waste heat throughout a greater mass of water thereby reducing the temperature gradient of the water mass absorbing the heat. In addition, the vortices would, as described above, enhance the reoxygenation of the effluent which, having been used to absorb heat, has given up much of its dissolved oxygen. This, again, would contribute to a more robust marine ecosystem.

Another beneficial application for the present invention is its use in aquaculture to generate desired currents for specific purposes. The generators may be configured to generate different currents at different locations in the same aquaculture site. They may also be configured to modify or divert existing currents in order to optimize flow conditions for specific crops without the necessity of constructing more costly structures or the installation of equipment, e.g., pumps, which would be required to perform the same functions.

Figure 4:
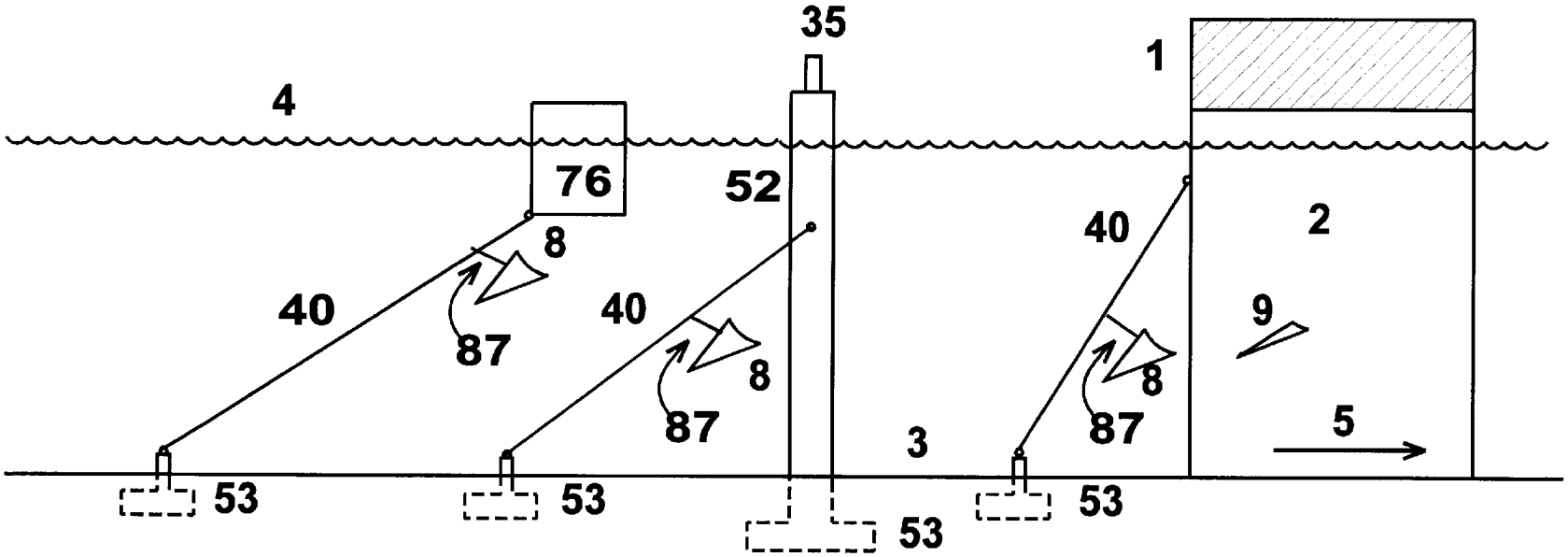
FIG. 4 is a side elevation of the bridge of FIG. 3 with alternative application modes of the novel devices.

Alternative methods of positioning DSVG (8) are shown in FIG. 4. The devices may be fastened to the pier (2) or to a strut (52) driven into streambed (3) upstream from pier (2) along lines 6, or positioned by means of other appropriate mooring anchors (53). Strut (52) may optionally have an aid to navigation (35) affixed to it which would enhance safe passage for water vehicles transiting, for example, a bridge.

The generators may be DSVG (8) or SSVG (9), and may be suspended from tethering means (40) attached to mooring anchors (53). In FIG. 4 there are four such cases shown variously supported by strut (52) or pier (2). The DSVG (8) are supported by linkages (87) to the tethering means (40) so that the relative flow causes the generator to operate as a lifting body thereby producing the forces required to generate the vortices. The operation is comparable to the operation of an ordinary air-borne kite. In the present instance the "kite," DSVG (8), is being forced downward toward the streambed (3) by the water flow instead of skyward by an airflow.

In another arrangement for supporting DSVG (8) shown in FIG. 4 the tethering means (40) is suspended between an anchoring means (53) and a float (76). This is a preferred mode of installation in water subject to varying depth such as tidal waters or waters liable to flooding. The float (76) rises and falls with the water surface (4) maintaining the attached DSVG (8) at a predetermined depth below the surface (4).

Alternative forms of the generators can be used to accommodate various specific site parameters.

Figure 8:
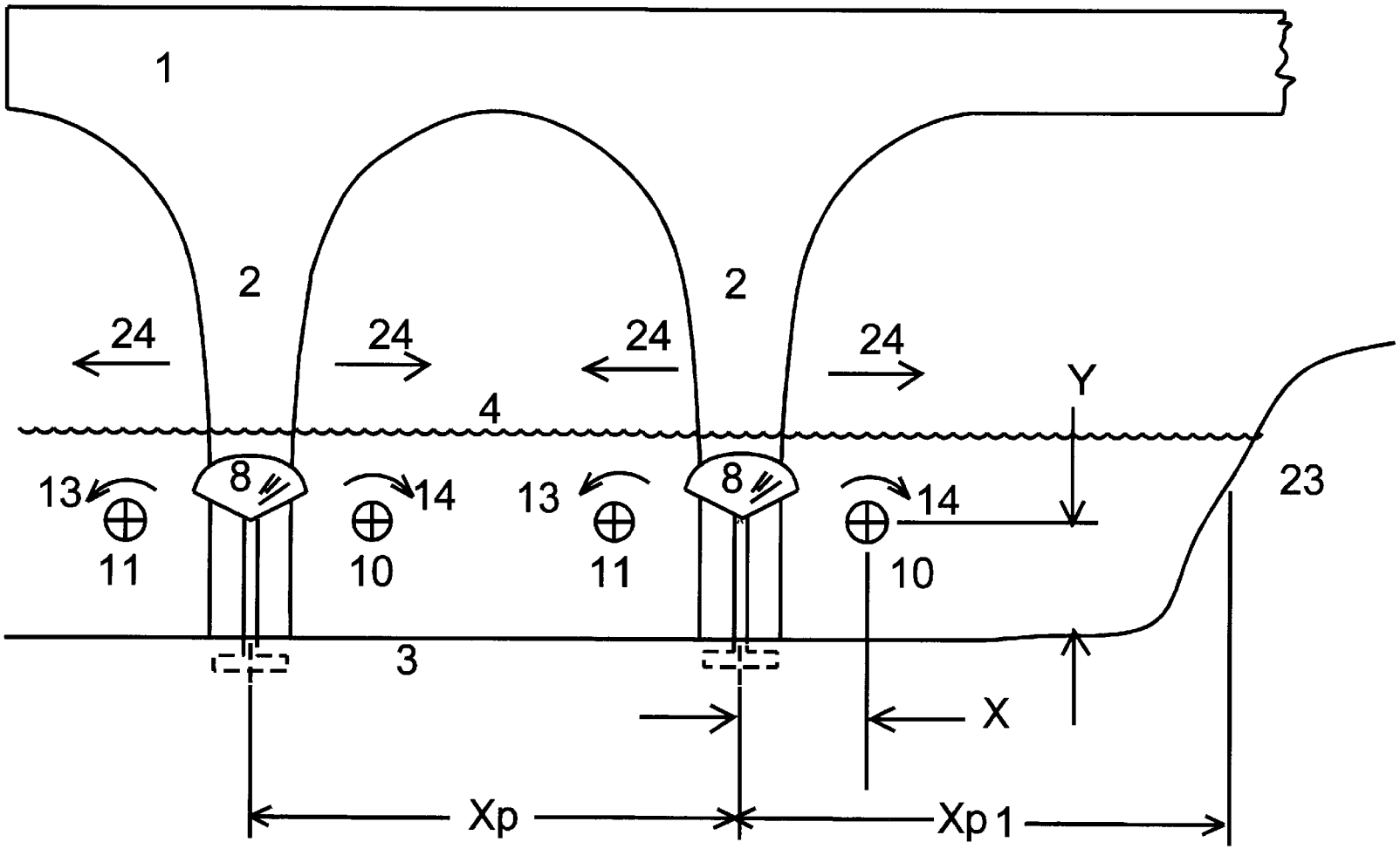
FIG. 8 is an elevation of a bridge with piers and river bank or similar boundary viewed from a point upstream from the bridge.

The preferred placement of the DSVG (8) will now be described. Referring to FIG. 8, the distance between adjacent piers or a pier and another structure measured perpendicular to the streamwise direction, is denoted by $X_p$. To differentiate, in the drawings, the distance between piers, $X_p$, from the distance between a pier and other structure, at least one of which it is desired to protect, the notation $X_{p1}$ is used. For purposes of calculation the expressions $X_p$ and $X_{p1}$ are equivalents.

The vortices at the bridge are (13) and (14), each rotating about a core. The core (10) of right-hand streamwise vortex (14) is shown at depth Y below the stream surface (4) and at a distance X from the pier (2) to be protected. We have determined that a preferred position of core (10) is such that X=Y and further that the optimum value of X is one-fourth the distance between the pier and the nearest other object or structure ($X_p/4$). In instances where the optimum value of X cannot be realized, a value less than $X_p/4$ is preferable. The left-hand streamwise vortex core (11) is positioned in the same fashion as right-hand streamwise vortex core 10, the difference being the direction of rotation of the associated vortex.

Preferably, the streamwise vortex is generated using a generator placed at a distance upstream from the structure to be protected greater than or equal to one-fourth of the distance between adjacent objects to be protected, such as two piers or a pier and a streambank.

In general the system performance improves as additional generators are installed, each being spaced upstream an incremental distance Zi from the next downstream generator. The improvement is effected by causing the force deflecting the debris to be exerted over a greater streamwise distance. This causes the debris to be more reliably diverted away from the pier. In practice, the number of generators would be limited by considerations of economic resources, as well as site-specific factors. However, a single properly sited generator performs very effectively.

Figure 9:
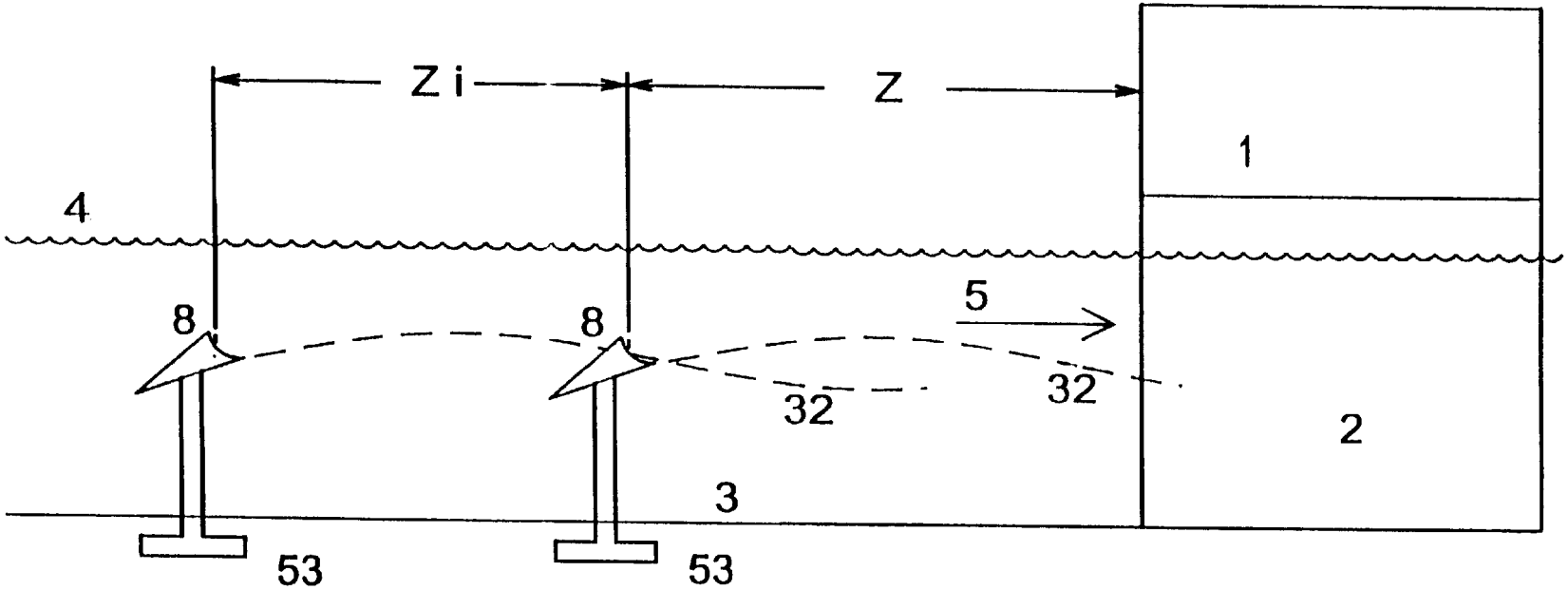
FIG. 9 is a side view of FIG. 8 viewed from but not including the river bank.
Figure 10:
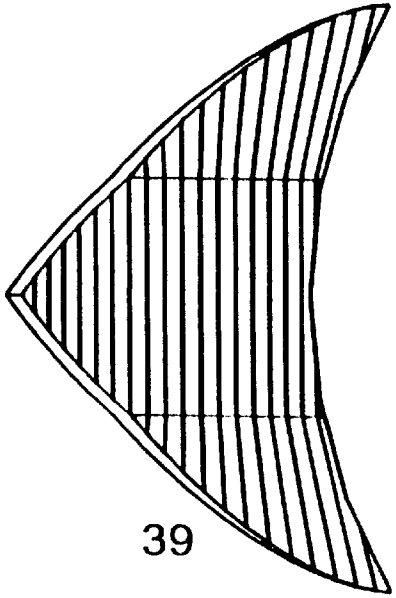
FIG. 10 shows plan, end and profile views of one of the vortex generators of FIG. 11.
Figure 10A:
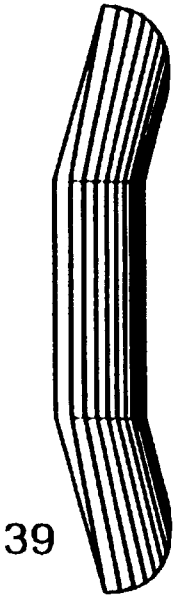
Figure 10B:
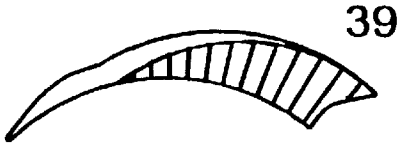

The streamwise spacing of the generators is illustrated in FIG. 9, a side elevation of bridge (1). The DSVG (8) nearest pier 2 is spaced upstream a distance Z. The next DSVG (8) is spaced upstream an incremental distance Zi.

If only one DSVG is used it will generate a pair of vortices which are generated with their cores spaced across the stream by a distance somewhat exceeding the span of the generator, $X_s$, as shown in FIG. 5. The distance separating the vortex cores increases as does the diameter of the vortices as the distance downstream from the generator increases.

Figure 31A:
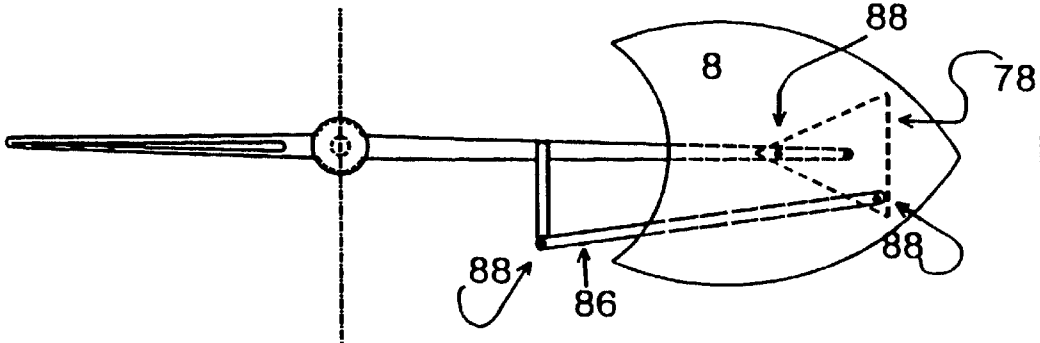
FIG. 31 illustrates a method of mounting DSVGs to accommodate changing flow angles of attack.
Figure 31B:
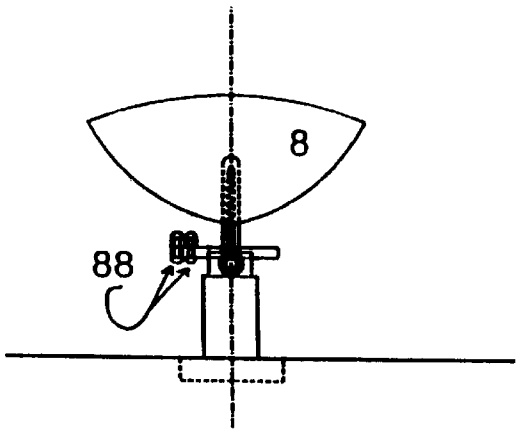
Figure 31:
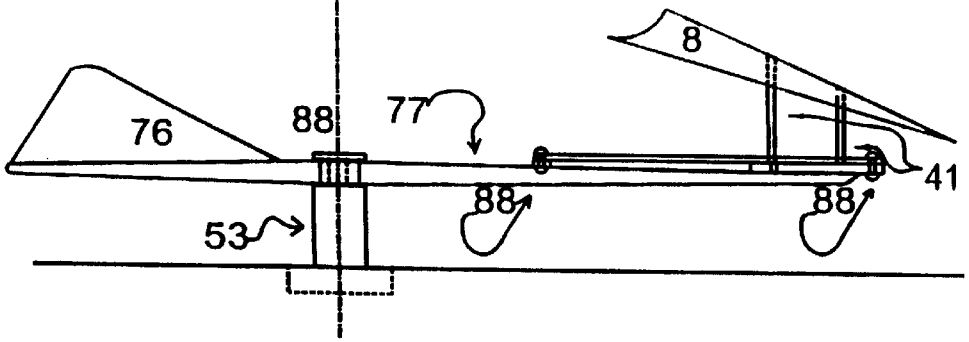
Figure 32:
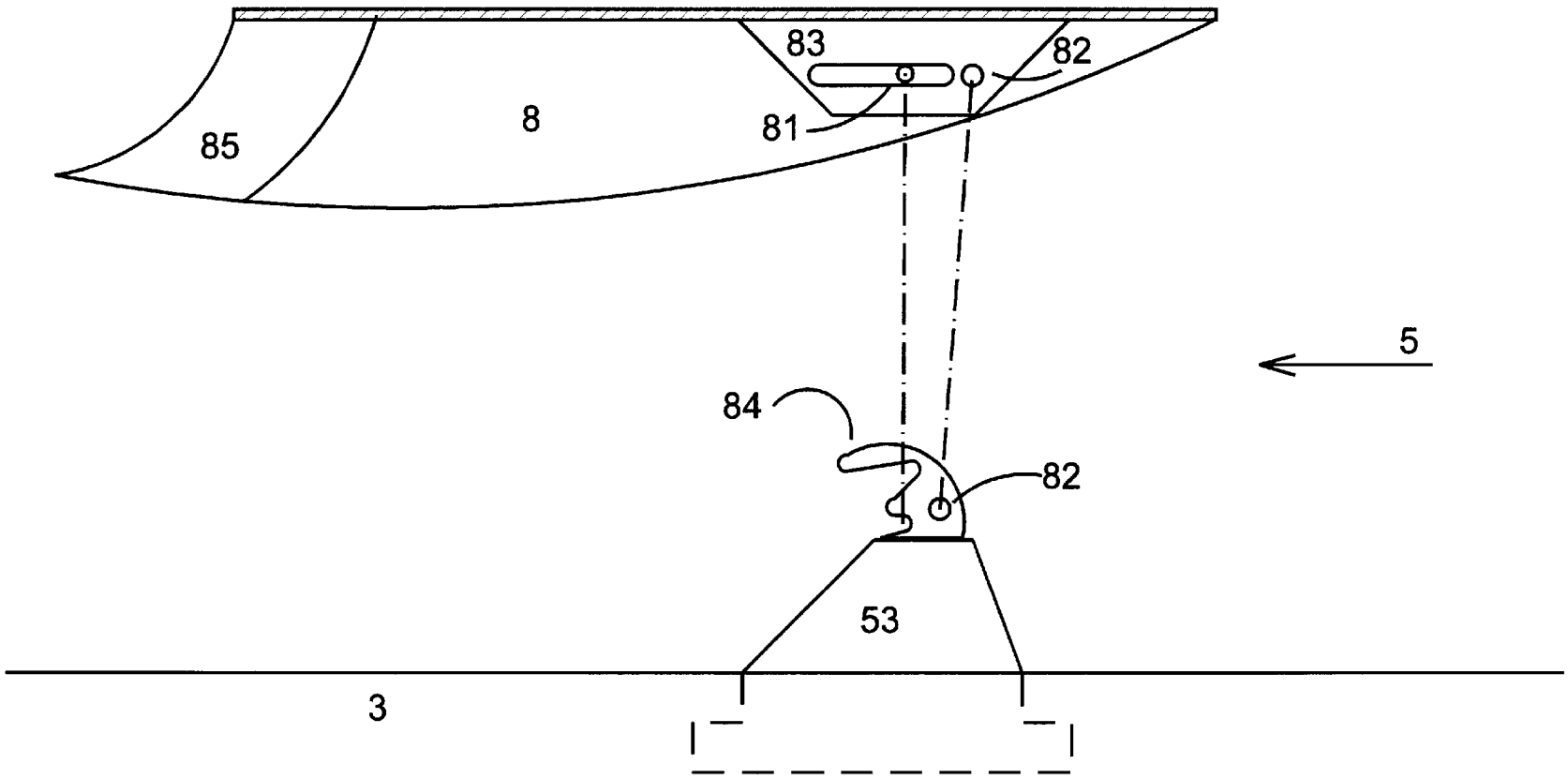
FIG. 32 shows a method of mounting a DSVG to accommodate flooding conditions at normally shallow sites.

A method of mounting a DSVG so that it can accommodate changing flow angles of attack, which may occur with increased flow as during flooding, is illustrated in FIG. 31. During normal flow conditions DSVG 8 is retained in position by pivoting boom 77. In practice boom 77 will allow a small amount of beneficial lateral oscillation, or "seeking." Vane 76 is an aid in both repositioning and stabilizing DSVG 8. DSVG 8 is retained close to its optimum position relative to the structure it is protecting by the action of linkage 86 shown diagrammatically in the drawing.

In quiescent flow DSVG 8 is held essentially horizontal by detent bar A resting in the lower notch of detent D. At the onset of a flooding condition a flotation section, structurally a part of the DSVG 8, starts lifting the DSVG, pivoting at B, until the water rises sufficiently to cause the detent bar A to seat in the upper notch of detent D. This positions DSVG 8 at its desired angle of attack to allow its generated vortices to divert buoyant debris from the protected structure. When the flood stage abates sufficiently the weight of DSVG 8 will return it to its "rest" position.

EXAMPLE 2: MITIGATION OF SCOUR

Figure 11:
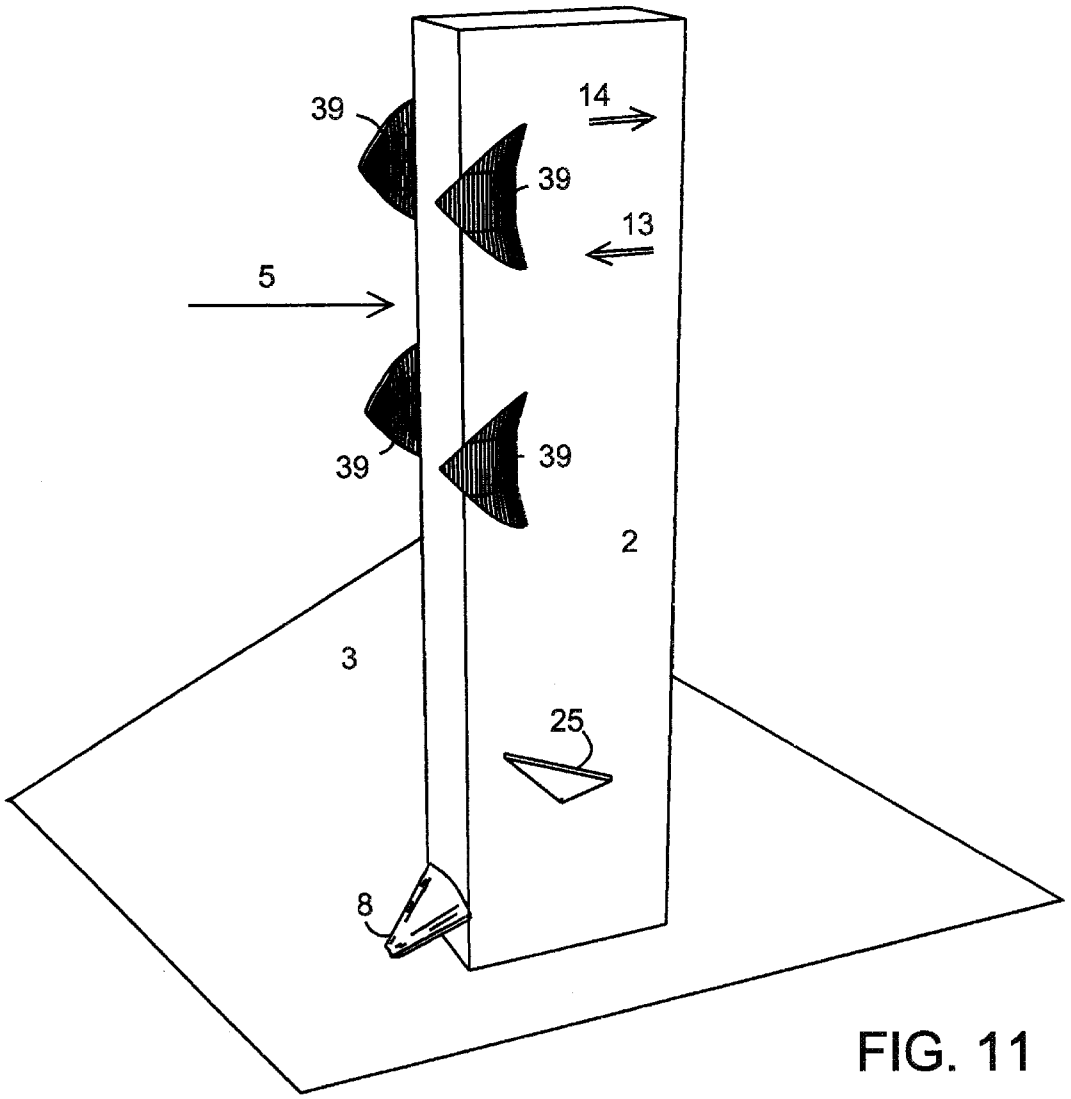
FIG. 11 is a perspective view of a pier fitted with vertically disposed vorticity- and vortex-producing structures.

Mitigation of scour caused by vertically disposed turbulent eddies naturally present along the sides of, or downstream of a bridge pier or embankment is best accomplished using devices attached directly to the protected structure. The devices used in this application are DSVG wings of low aspect ratio, the surface of which may be planar, multiplanar or curved. The preferred embodiment is an arcuate rearward (downstream) face configuration. In FIG. 11 wing DSVGs are denoted by 39. These wing DSVGs are highly cambered, so that energy from the stream is converted into streamwise vortices which are horizontally disposed adjacent the pier. The wing DSVG 39 is at an angle of attack such that its downwash is directed toward the side surface of the pier and streamwise vortex 14 is generated right hand while vortex 13 is generated left hand. Wing DSVGs 39 on opposite sides of pier (2) may be considered mirror images as may also be the vortices generated by them. These energetic vortices interfere with the vertically disposed vortices and inhibit the transfer of energy into scouring action both at the sides of the pier and at the downstream face of the pier.

Vertically disposed vortical energy which may still exist is converted into horizontally disposed streamwise vortices by the plate (25). This plate, shown schematically in FIG. 11, may be of previously described SSVG configuration or a generally triangular plate. The unique feature of plate (25) is realized from its nose up attitude. In this way it acts to guide the vertically disposed vorticity into horizontally disposed vortices.

A truncated DSVG (8) shown at the base of the upstream face of pier 2 in FIG. 11 contributes to the management of horizontal vorticity naturally occurring at the nose of the pier. The structure is preferably a DSVG (8), disposed upwardly to the face of the pier, with its vertex pointing downward and upstream. Vorticity springing from the edges of the DSVG (8) cancels the vorticity occurring naturally near the face of the pier. Since DSVG (8) does not allow vorticity to form additional or secondary vortices, the risk of horseshoe scour is mitigated. DSVG (8) may be used in conjunction with plate (25) and wing DSVG 39.

The rear of the DSVG 8 is chosen to be about the same width as the pier (2). In this application the DSVG is truncated so that the dimension at a—a, FIG. 11, is approximately 30% of the width of the pier. The device is then situated so that the vertical angle is approximately 55° to the horizontal, presenting a convex surface to the approaching stream. The device can deviate from these preferred dimensions. The device can be supported by members bearing on the upstream face of the pier and the underside of the device. The method selected to suppurt the DSVG 8 in this application should allow cross-flow, below the device, between the device and the pier.

Figure 23A:
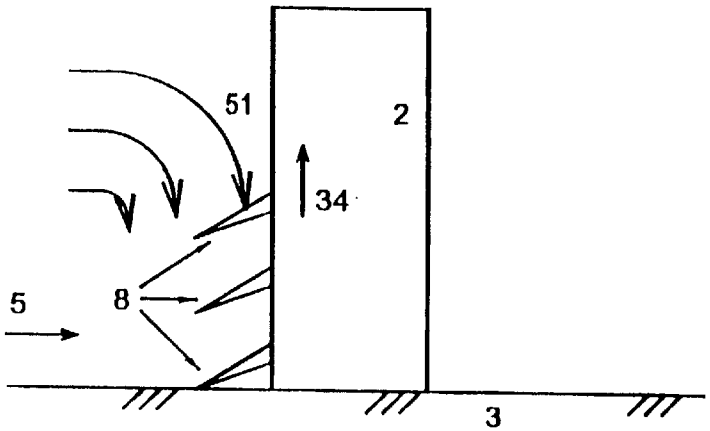
FIG. 23 is a schematic profile view of a pier with a single scour-mitigating DSVG and one with multiple DSVGs.
Figure 23:
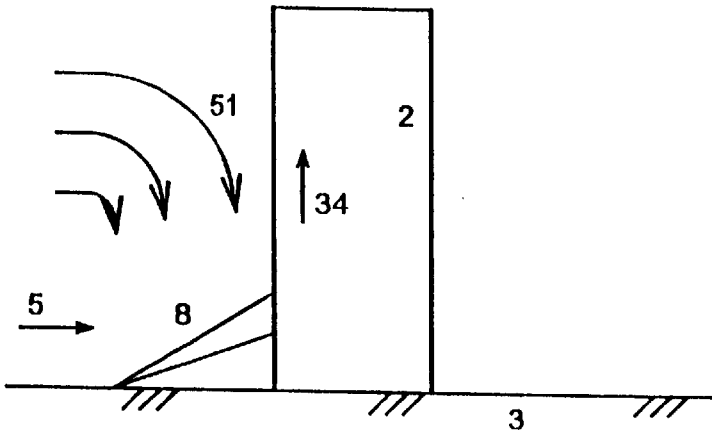

The use of a plurality of DSVGs affixed to the nose of a pier is illustrated in FIG. 23, a side elevation view of a pier 2 shown schematically. Arrows show how the downward component 51 of the flow is intercepted by the single DSVG (8). The companion view shows a plurality of devices of smaller streamwise extent used to perform a similar function. Each of the three devices shown intercepts a portion of the downward motion.

One element of the system utilizing the flow and characteristics of a stream is a drag-producing body producing a wake defect in the downstream velocity profile which acts to mitigate scour downstream of the drag-producing body.

Figure 14:
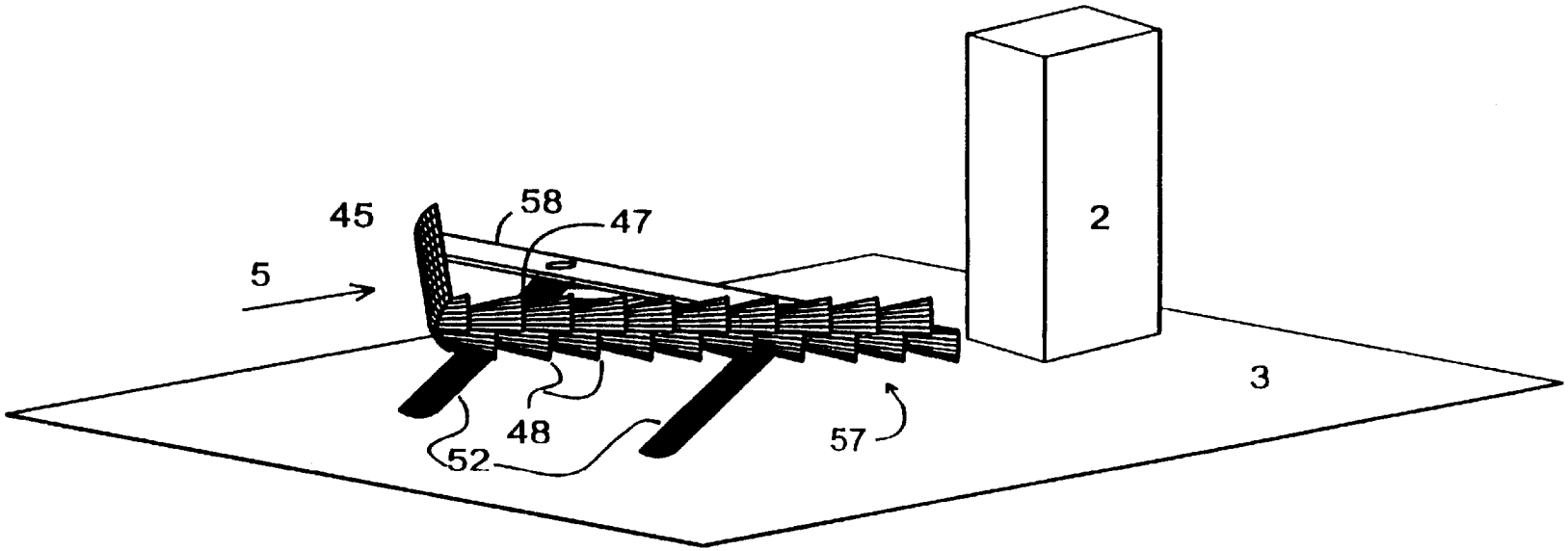
FIG. 14 is a perspective view of a pier such as a bridge pier with the novel drag producing structure shown diagrammatically upstream of the pier.
Figure 15:
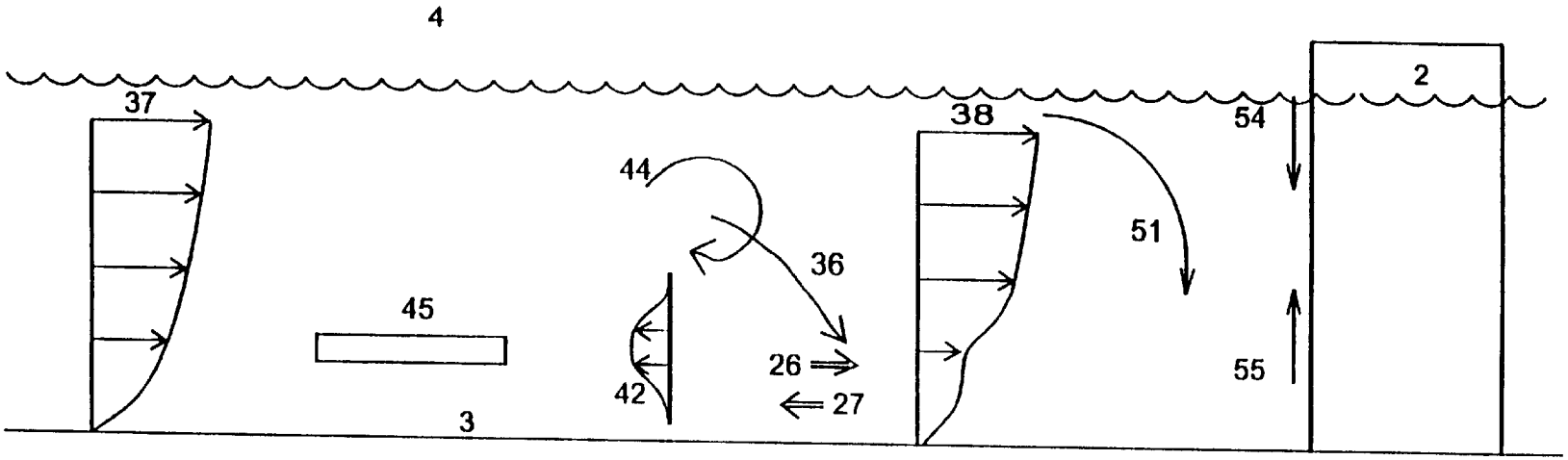
FIG. 15 is a profile view of FIG. 14 with a schematic representation of the vertical average velocity profile upstream of and downstream of the novel drag producing structure.

FIG. 14, 15, 16, and 17 show perspective, profile, front elevation, and plan views of a pier 2 embedded in a streambed 3 with stream flow 5. In FIG. 15 profile 37 represents the average velocity in direction 5 versus vertical height above streambed 3. As the flow impacts pier 2 a portion of its kinetic energy is transformed into potential energy. When the flow moves further downstream, this potential energy is converted back into kinetic energy. Profile 37 shows that the higher vertical distances above the bed have greater kinetic energy. Therefore, the potential energy on the face of the pier will not be balanced and a portion of this potential energy will be converted to kinetic energy diverted downward along path 36 toward streambed 3. The result is the formation of horizontally disposed vortices which remove streambed particles immediately adjacent pier 2, FIG. 16, resulting in a horseshoe shaped local scour cavity 46 around pier 2.

The novel drag producing structure 45, located upstream of pier 2, is represented schematically in FIG. 15 and is positioned above the streambed 3. The location is chosen so that the wake or velocity defect 42, caused by the device, impacts pier 2 above the streambed 3. The potential energy at the center of the wake is lower than either above or below this point. The unbalance of potential energy now induces an upflow at the face of pier 2 in the direction 55. This induces a much weaker vortex which rotates in the opposite direction to the one which occurs naturally from downflow 54. This weaker vortex scours significantly less than that caused by 51 and is rotating in a direction which diverts sediment toward the pier instead of away from it. The upflow 55 opposes the downflow 54 thereby preventing the energy of downflow from contributing to local scour cavity 46.

The novel drag-producing structure also acts to reduce contraction scour. For scour to occur kinetic energy from the higher vertical regions must be transferred down to the streambed 3 or into a scour hole such as 46. A major portion of this energy comes from large scale turbulent eddies represented by 44. The velocity defect 42 produced by the novel device persists downstream and absorbs or deflects this energy before it can reach the streambed along path 36. The streambed is thereby protected from scour for a significant distance downstream of the device. By locating the device so that this protected region corresponds with the region where contraction scour will normally occur, a significant beneficial reduction of scour can be realized. The protected region may be extended streamwise or laterally by appropriate siting of additional devices.

The constraint of vertical turbulent motion mitigates contraction scour employing either a solid, porous or hybrid body elongated in the streamwise direction. The device may be used alone or in conjunction with DSVGs or SSVGs or other wake-producing devices to mitigate scour. Devices disposed at a positive angle with respect to the stream flow will constrain horizontal turbulent motions. This configuration of drag-producing elements mitigates downstream scour and bank erosion.

Figure 16:
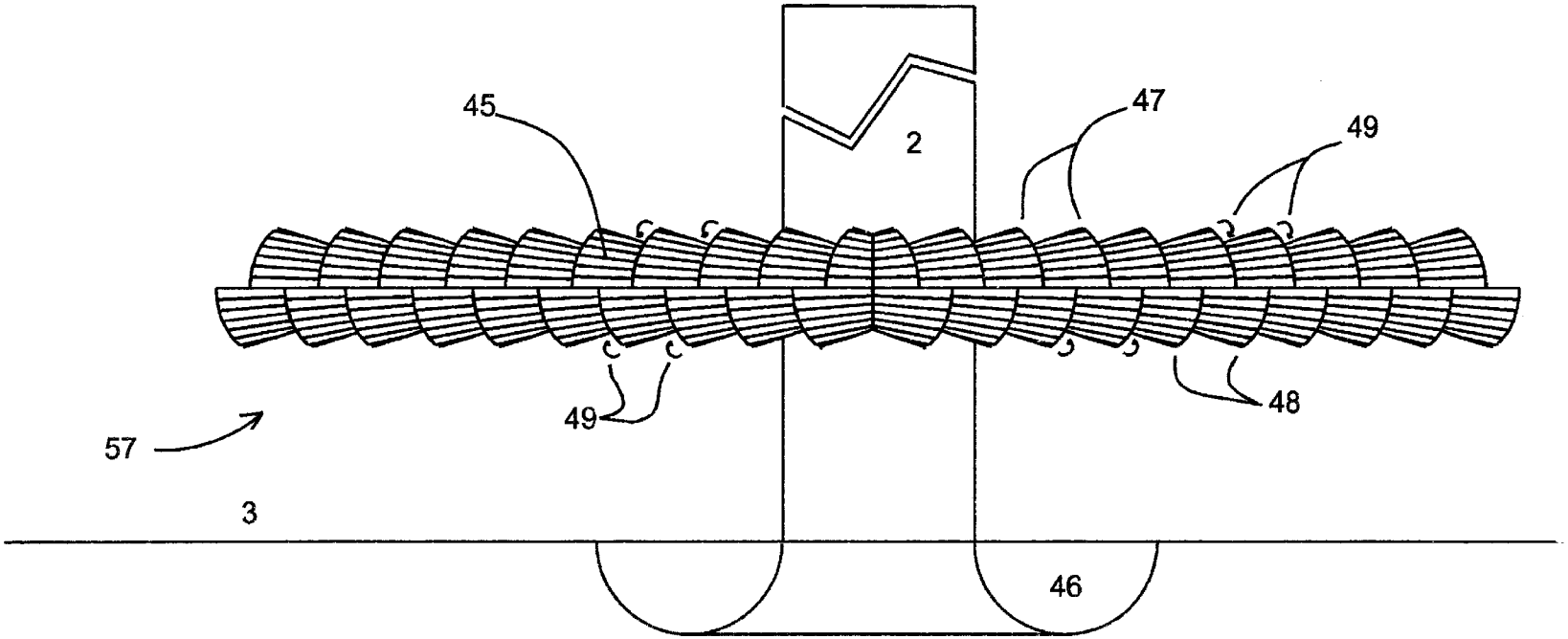
FIG. 16 is a front elevation of FIG. 14.

To avoid creating large eddies, the preferred configuration of the novel structure consists of a tandem arrangement of drag producers comprising an upstream member 57 and a downstream member 58 as shown in FIG. 14. The upstream member 57 is thicker than the downstream member to efficiently produce drag. The downstream member 58 is elongated in the downstream direction to be effective in reducing any larger eddies which may be produced by 57. As shown in FIG. 16, the upstream member 57 is configured by varying the vertical thickness of member 57 in an offset opposed sawtooth pattern, the top points (47) of the sawtooth profile being spaced mid-way between the bottom points (48) of the sawtooth profile in order to produce small scale eddies, or streamwise vortices, which further inhibit the scour event.

Figure 17:
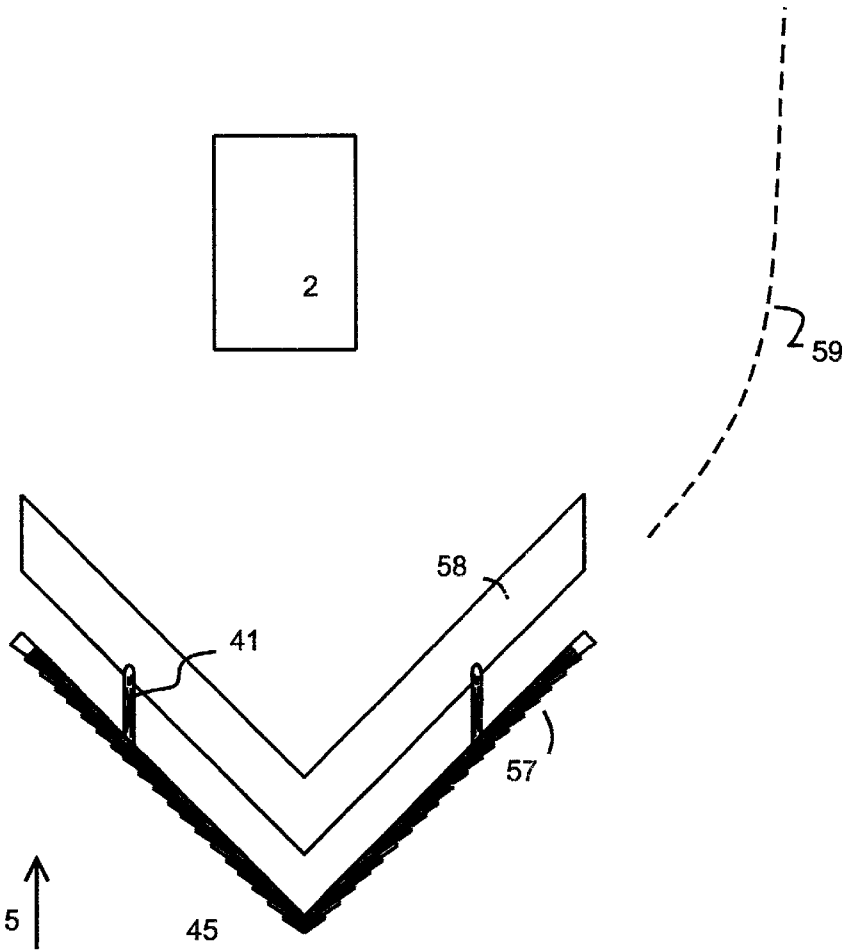
FIG. 17 is a plan view of FIG. 14 showing a detail of a preferred "V" configuration.
Figure 18A:
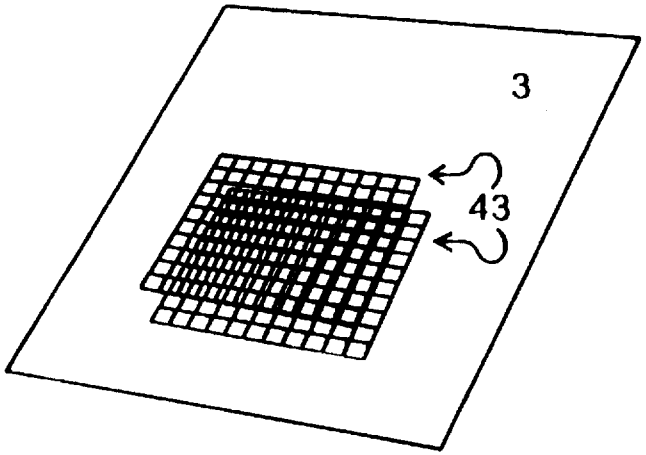
FIG. 18 gives perspective, plan, cross-stream and downstream views of a site of the novel perforated drag-producing anti-scour devices.
Figure 18B:
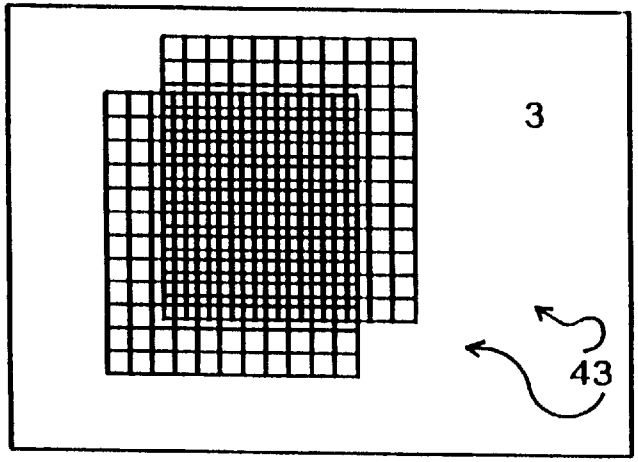
Figure 18C:
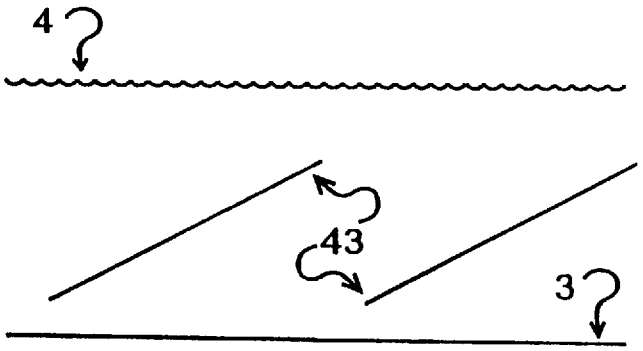
Figure 18D:
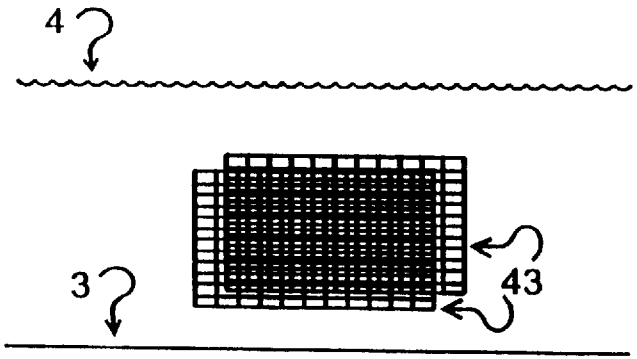

As shown in FIG. 17 the plan view shape of the upstream member (57 is a "V" shape, the apex of the "V" pointing upstream, centered in line with the center of protected pier 2. Both members 57 and 58 are supported above the streambed 3 by struts 52 which are preferably inclined rearwardly as in FIG. 14. The upstream member 57 is configured to minimize entrapment of debris or, in the event that debris does become entangled with it, to facilitate its being disengaged by the stream flow.

The preferred configuration of the downstream member 58 is also "V" shaped. It could have portions which are similar in shape to 57. The important parameter is that any upstream point of 58 be located downstream from the corresponding point of 57 a distance equal to or greater than 1.5 times the vertical thickness of 57 or the streamwise extent of 57, whichever is greater. For simplicity in viewing the perspective view FIG. 14 uses a straight member 58 rather than the preferred "V" shape.

The direction of the long portion of the sawtooth profile which determines shapes 47 and 48 are chosen so that they point in the general downstream direction. This is a further aid in preventing the trapping of debris on 57 since the rolling motion of the fluid in the notches as shown by 49 in FIG. 16 helps move the debris along path 59.

A small amount of scour beneath the device is desirable to prevent buildup of material which would interfere with the wake forming function. If a sediment dune were to move into the region underneath the members 57 or 58 their function would become impaired. To prevent this, certain of the notches near the center of the "V" are enlarged to ensure that an undesirable dune or other sediment accumulation does not form.

Figure 22B:
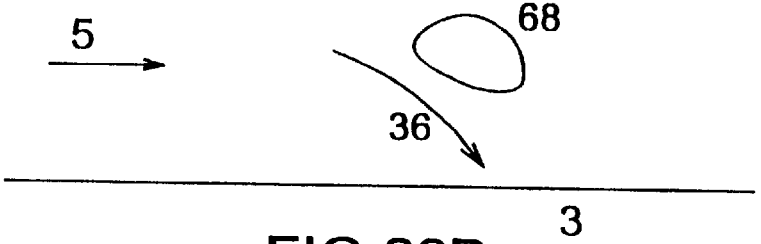
FIG. 22 illustrates one mechanism of scour and the mechanism of introducing large velocity defects in a flow to mitigate scour.
Figure 22A:
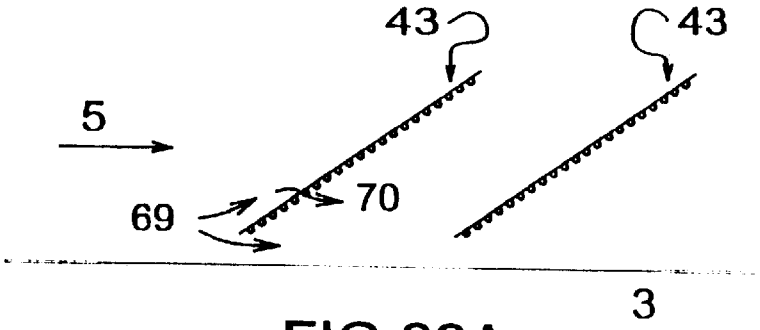

Another embodiment of this concept is shown in FIG. 18 and FIG. 22. These figures illustrate the method of producing exceptionally large velocity defects without inducing counter-productive large scale turbulence. In "B" of FIG. 22 a streambed 3 is shown with flow direction 5. A schematic flow blockage element 68 is shown suspended above the streambed. As the flow attempts to go underneath the blockage, it will accelerate. If the blockage is large enough and close enough to the bed, scour will occur. The scheme illustrated in "A" of FIG. 22 will allow large flow blockage effects, with corresponding large velocity defects without causing scour at the bed. Two inclined grids 43 are shown in the figure although a larger plurality of grids is also contemplated. The grids are shown inclined at an angle of about 30 degrees and the porosity of the grid varies so that the blockage becomes greater as the vertical distance above the streambed increases. As the flow approaches the lowermost portion of the upstream grid it encounters little resistance. Although some of the flow is diverted downward toward the bed, it is not enough in itself to cause scour. The rest of the flow is diverted upward towards 70 where it encounters additional blockage. However, the flow at point 70 can not get to the streambed without traversing the grid 43. Thus, the part of the stream which goes through the grid to 70 loses energy and can not cause scour. This process continues up the entire length of the grid where progressively increasing velocity defects are generated.

The process is essentially repeated at the downstream grid where, operating in the flow modified by the upstream grid, produces considerably more robust velocity defects without causing streambed scour beneath the device. Virtually any degree of velocity defect can be generated by properly siting a plurality of similar devices.

Both grids 43 constitute a damping body elongated in the streamwise direction. Thus, the grids cooperate to eliminate unwanted large turbulent eddies. A perspective view of the grids and their spacing is given in FIG. 18 which helps elucidate this point.

FIG. 18 is a perspective view A, a plan view B, a side view C and a streamwise view D of the device of FIG. 22. Illustrated is a device 43 with lateral extent less than the stream width. The previously scoured lateral region downstream of 43 will then have reduced scour while continuing scour outside the protected area will contribute to the maintenance of a deeper channel for flow and navigation similar to that shown in FIG. 17 at path 59.

Figure 19:
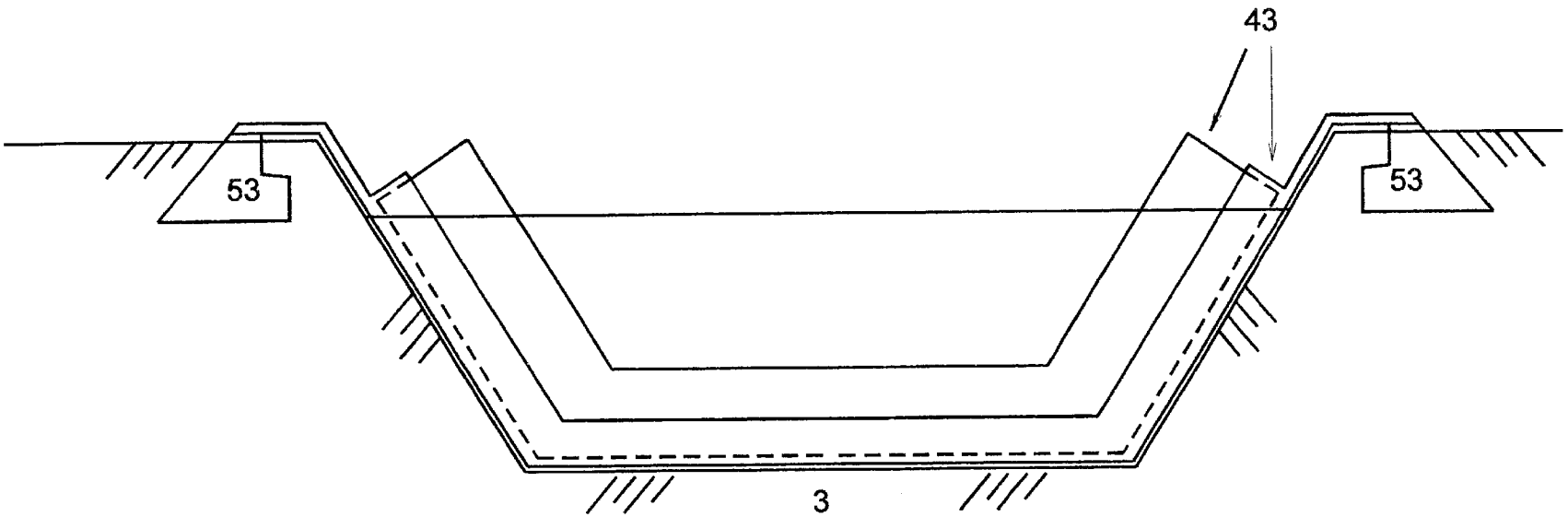
FIG. 19 is a streamwise view of the method of scour-protection for a channel or inlet, along with its banks.

FIG. 19 is an elevation that shows schematically this concept applied to a channel such that both side walls or banks of the channel as well as the streambed are protected from scour. The construction of grids 43 near the streambed in this figure are the same as described above. Each grid is extended so that it remains in approximately the same perpendicularly spaced relationship to the side banks as it is to the streambed. Various slopes of channel walls as well as vertical walls can be accommodated. The concept is equally applicable to a single wall, bank or levee.

Figure 20:
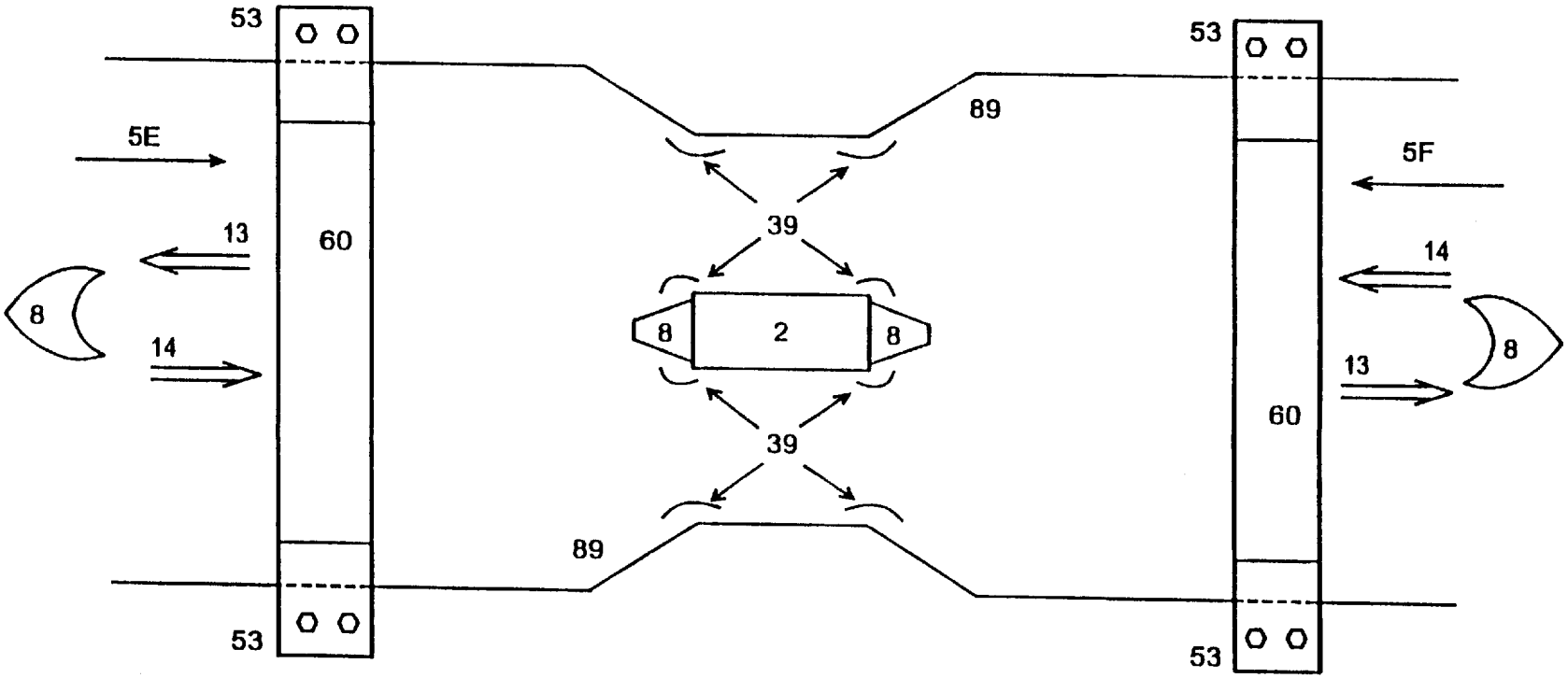
FIG. 20 is a plan view of a tidal inlet with the novel system installed to provide protection during both ebb and flow tides.

Tidal inlets and bridge piers may also be protected by the instant invention. A tidal inlet is illustrated schematically in FIG. 20. The pier 2 as well as the sidewalls 89 are subject to alternating flow from direction 5E and 5F. DSVGs 8 are positioned to deflect floating debris as previously taught. No adverse effect occurs due to the DSVGs 8 during reversed flow provided the DSVGs are properly sited and anchored. The same is true of the wing DSVGs 39 illustrated.

The multiple inclined grids described above have an adverse effect due to a tendency to transfer energy downward toward the streambed in reversed flow. The configuration shown in FIG. 21 does not have this effect. The grids 43 are replaced with an assembly comprising elongated members 73 of generally cusp shape cross-section, each elongated element spaced horizontally from its adjacent element a distance not exceeding the width of an element.

Figure 21:
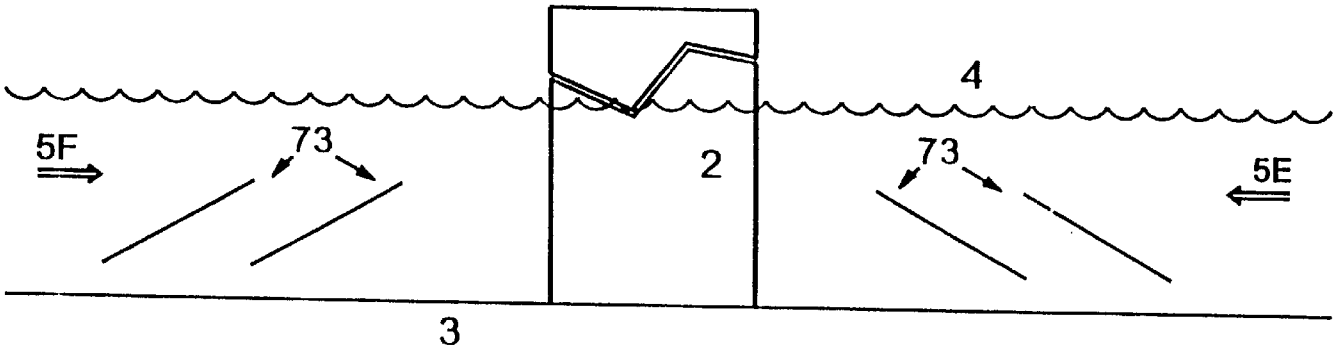
FIG. 21 gives plan and profile views of a site of the novel parallel-member construction.
Figure 21A:
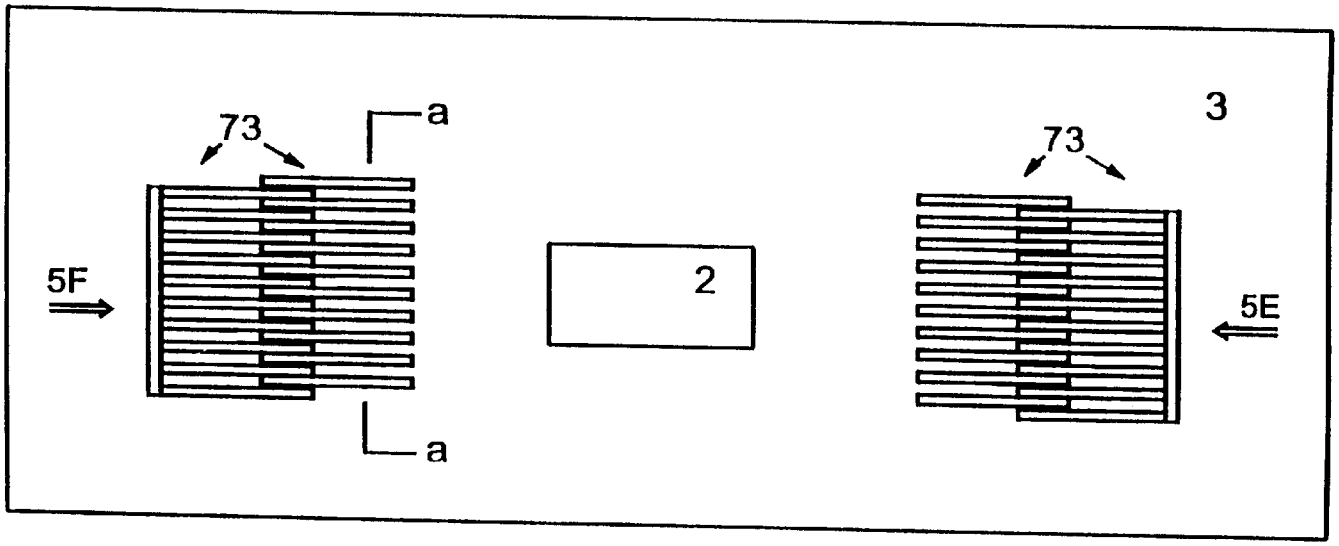
Figure 33A:
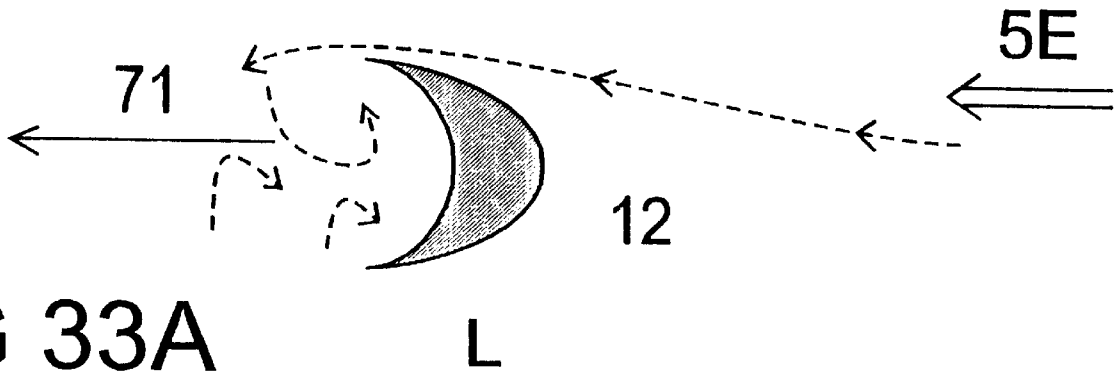
FIG. 33 illustrates the flow at Section a—a of FIG. 21.
Figure 33:
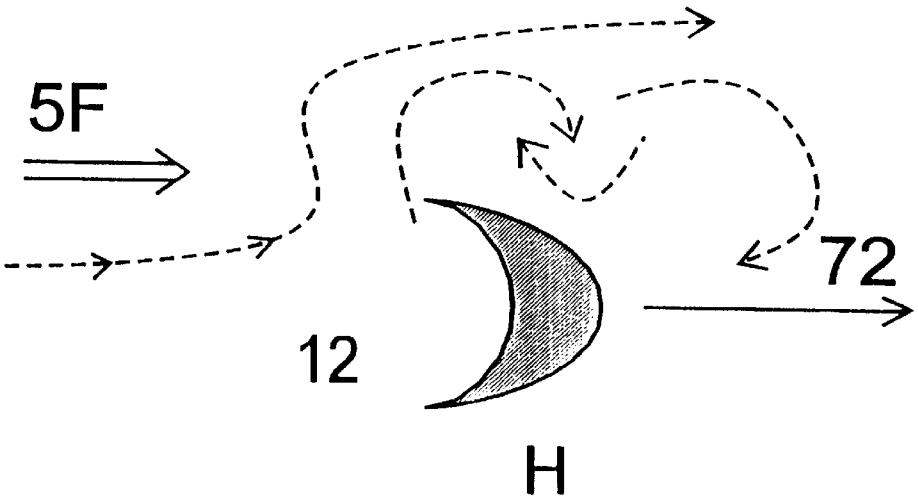

As illustrated in FIG. 33, a section a—a of FIG. 21, when the flow approaches the convex portion of the cusp 12 it has a tendency to curve around the body resulting in a condition of low drag. Upon flow reversal, approaching the concave portion of the cusp the flow is separated sooner and the streamlines widen resulting in a condition of high drag as indicated by the flow lines in FIG. 33. The low-drag condition results in a correspondingly smaller velocity defect and a reduced tendency to block the flow and force it downward. Alternately, when the flow reverses the high-drag condition produces a scour-protective velocity defect in the flow. The cusp shapes shown are preferred for this embodiment, but any drag producing device could be used which produces the required alternating drag with alternating flow directions. A movable device whose drag depends on flow direction is contemplated here, however, the simpler embodiment illustrated is preferred.

The elevation view in FIG. 21 further illustrates the functioning of the device. The higher drag configuration is always upstream of the pier or bed to be protected. This operates in the same manner as the grids described above. When the flow reaches the downstream member, the effect of the reversed angle of the device is to direct energy toward the bed. But, the effectiveness of the downstream device is less than the upstream device due to its lower drag. Hence, the downstream device can not undo the effect of the upstream device and no scour results in its vicinity. The pier or contraction region between the devices is protected as before.

The parallel member array is superior to the grids in that debris which may bounce or partially contact the bottom is less likely to become entangled in devices which are oriented substantially parallel to the flow.

Figure 29:
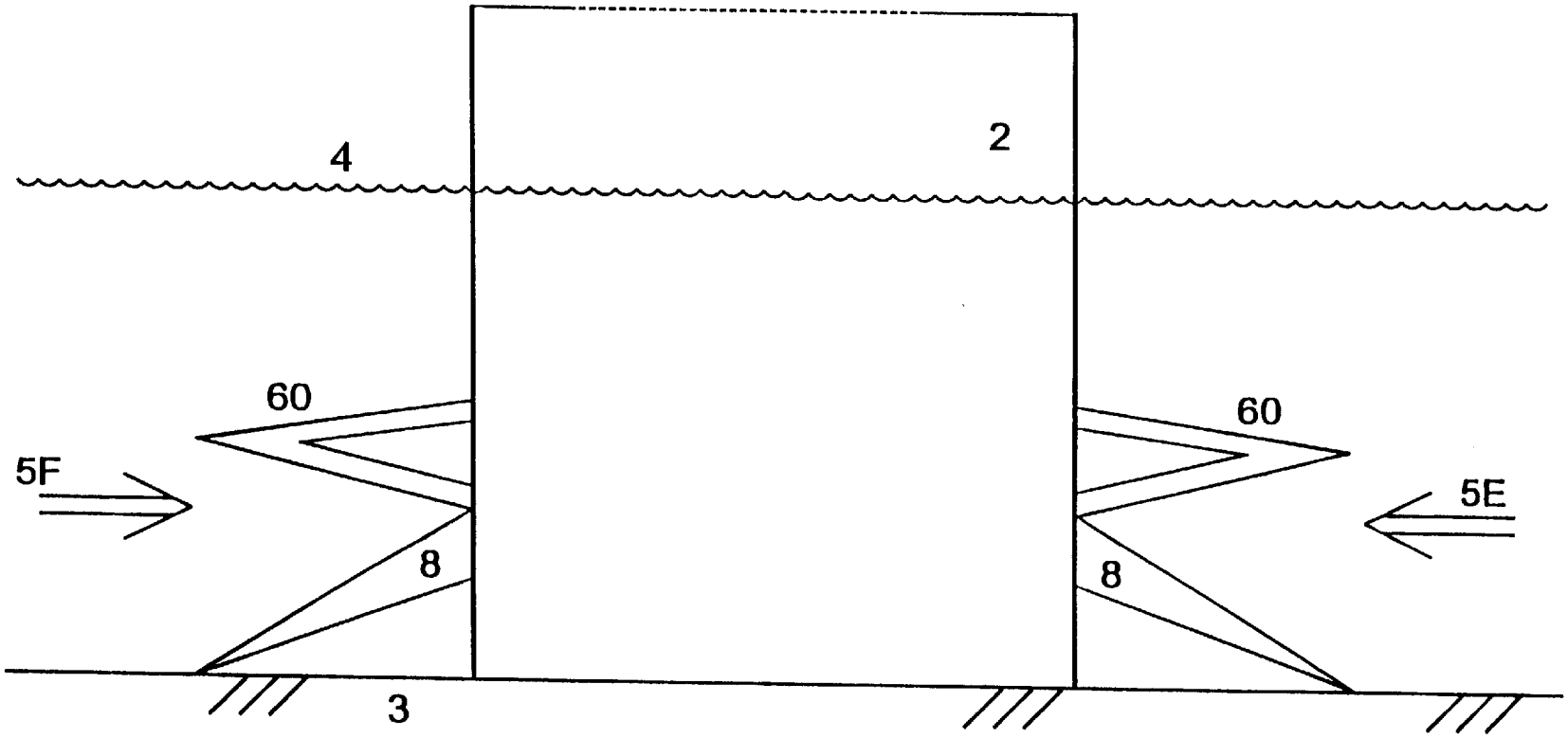
FIG. 29 shows, in side elevation, a pier situated in a tidal flow with DSVGs affixed at each end along with an array of porous elements to protect it from scour during both ebb and flow tides.
Figure 30A:
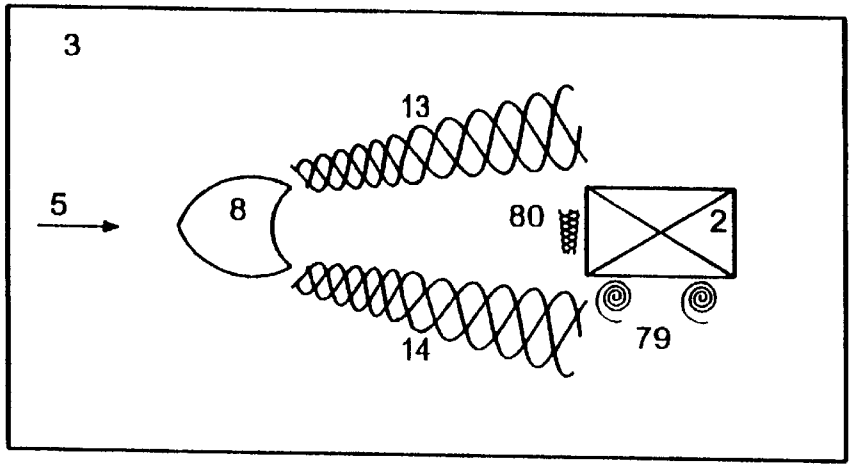
FIG. 30 shows plan and profile of a generic stream with salient features indicated.
Figure 30:
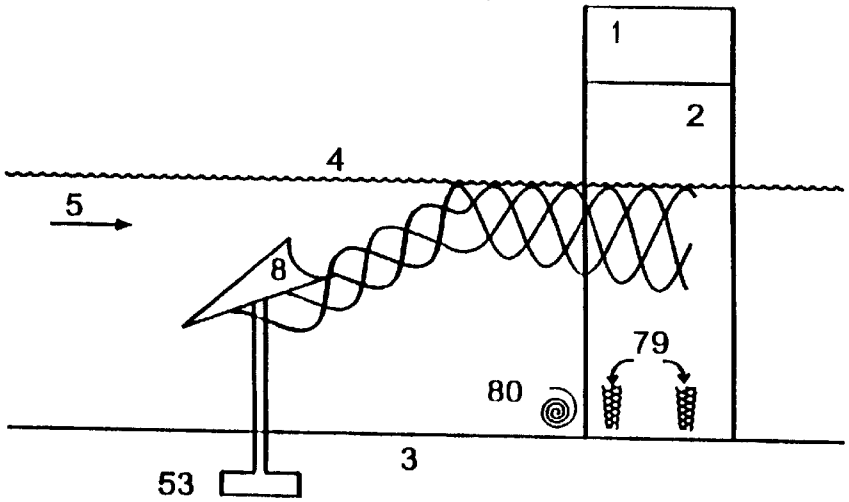

FIG. 29 illustrates, in side elevation, pier 2 with DSVGs 8 affixed to each end, functioning as described for FIG. 11. The illustrated configuration provides protection to structures in tidal or reversing flows. The downstream device, located in the wake region of the pier, has little effect on the flow. The recirculating flow in the downstream wake of the pier causes vertical eddies shed by the pier to touch down sporadically and scour the bed. Grid array 60 is to mitigate wake scour. One array 60 is affixed to each end of the pier. Both arrays 60 are in a triangular configuration to withstand the force of the water and debris impact.

The upstream array reduces the energy in the downflow at the upstream face of the pier helping the DSVG 8 reduce local scour. The downstream array damps out the part of the wake recirculating flow responsible for the touch-down of the vertical vortices and so mitigates the wake scour. Functions at each end of the pier 2 are interchanged upon flow reversal.

Figure 24A:
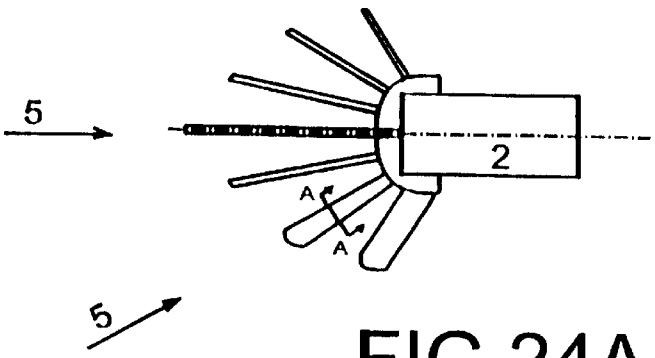
FIG. 24 shows plan and profile views of an installation of a multi-element functional assembly affixed to the upstream face of a pier, comprising hydrofoil cross-section members, disposed to provide continued protection with changes in angle of attack of stream flow.
Figure 24:
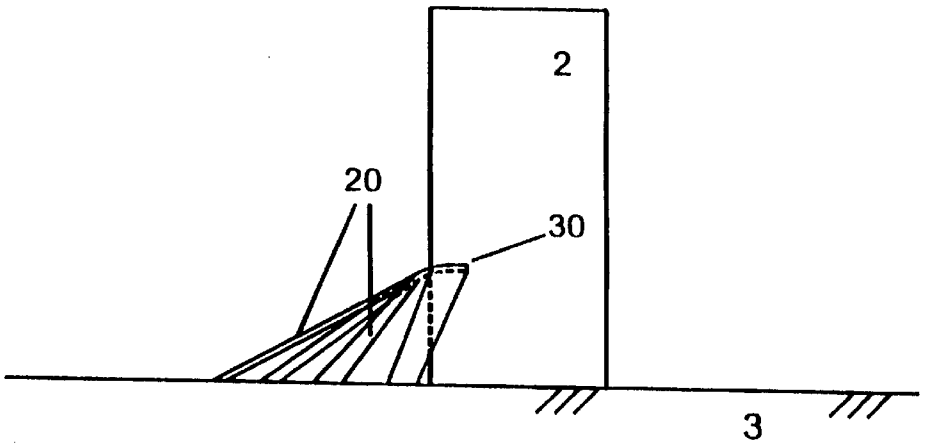
Figure 34B:
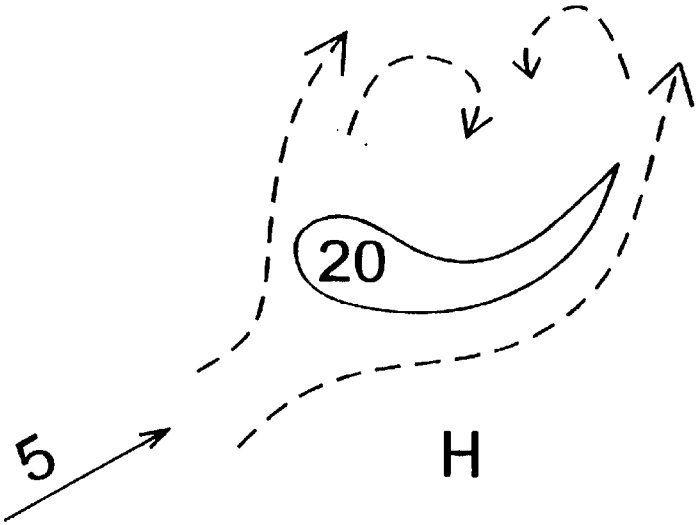
FIG. 34 illustrates the flow at Section A—A of FIG. 24.
Figure 34A:
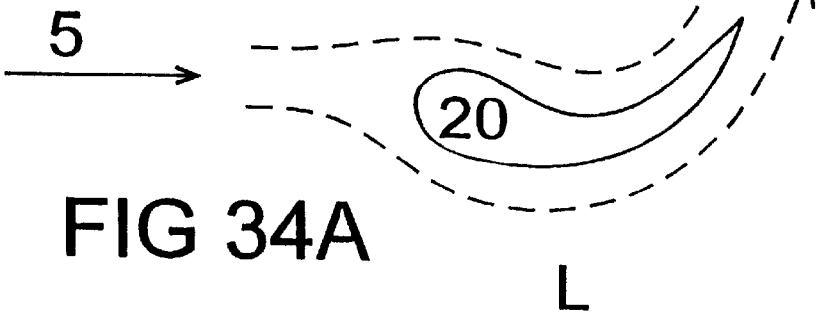
Figure 34:
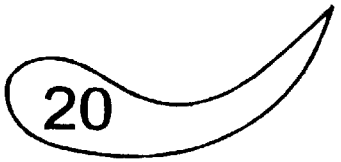

One of the elements of the novel system combining the functions of drag-producing bodies and lifting bodies is shown in FIG. 24. The functional assembly is comprised of a plurality of elongated bodies 20, seven of which are illustrated schematically in the figure secured to the upstream face of a pier. The distinction between a drag producing body and a lifting body is illustrated in FIG. 34. Illustrated at L is a lifting body in its lift mode. Such a body necessarily produces some drag due to the friction of water flow along its surface. The major effect of the body is to generate a substantial amount of vorticity at its salient edge. In contrast to this, the body, shown at a large flow angle of attack at H produces a flow, in this drag mode, of a fully stalled lifting body with a recirculating wake region downstream. There are intermediate modes between these two angles of attack wherein both lift and drag are produced.

The element shown in plan and elevation utilizes both of these modes of the hydrofoil section. The elongated members are disposed around the upstream nose of the pier. Attachment to the pier is at the same point as an equivalent solid-surface truncated DSVG. The elongated members merge in this region and it has been determined that approximately one quarter of the upstream extent of the device adjacent the pier should be without gaps as illustrated. The member on the centerline is disposed in the upstream direction in the same manner as the central portion of the solid-surface DSVG. The members adjacent this central member are disposed upstream and laterally as are each succeeding adjacent member. The cross-section at each location for each member is chosen to produce a similar effect to DSVG 8 in FIG. 11. Due to its triangular planform, DSVG 8 in FIG. 11 prevents the formation of additional vortices by the approaching flow so the vorticity shed at its edges effectively cancels that which would otherwise cause local scour. The section of each member, is chosen to generate vorticity in approximately the same magnitude and sign as the DSVG 8 in FIG. 11. The plan shape of the elongated members taken as a group also prevents the generation of new vortices so the vorticity is canceled and local scour mitigated as in the action of 8 in FIG. 11.

The device of FIG. 24 is especially useful when a possible change in stream direction is contemplated. A change in direction is shown at B by arrow 5. In this case, the section a—a now operates in the drag mode rather than in the lift mode. It prevents the unmodified oncoming flow impacting the pier and the device continues to function as a local scour mitigator for the altered angle of attack.

Figure 25A:
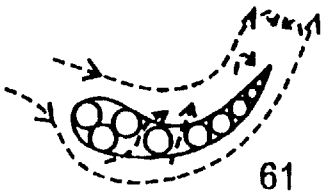
FIG. 25 shows sections of hydrofoil and DSVG comprising tubular or cylindrical members so constructed as to allow some flow-through while continuing to perform their primary design function.
Figure 25:
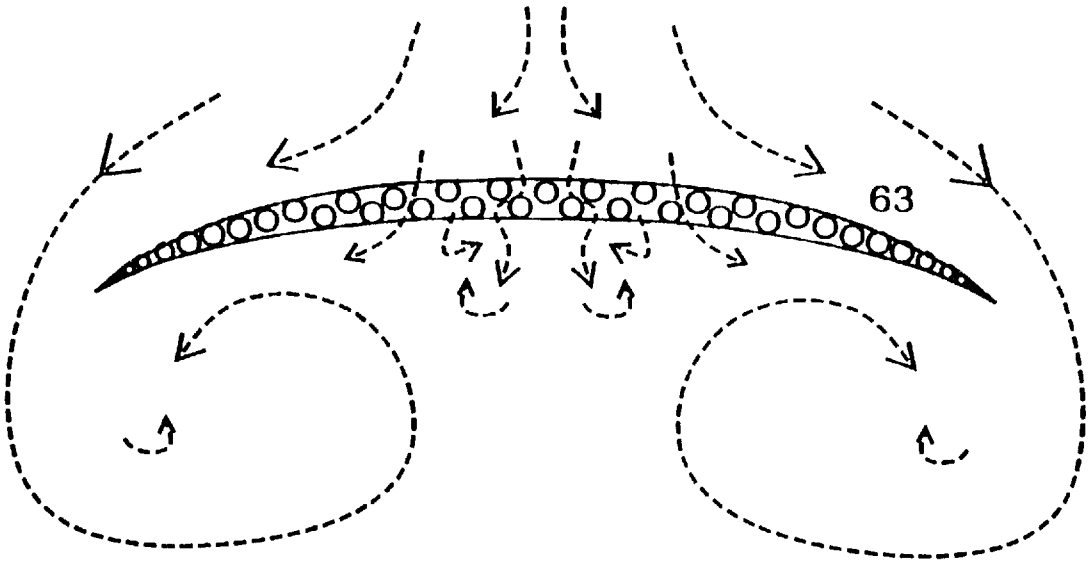

In a similar fashion the DSVG or the SSVG can be constructed of porous materials which allow some flow-through. In FIG. 25 section 61, a component as 20 of FIG. 24 is constructed of separated elongated cylindrical members disposed streamwise as 63, a section of a DSVG as 26 in FIG. 5. The members allow some flow-through while generating the flow pattern required of a DSVG. The resulting flow has characteristics of both a drag producing device and a lifting device. Section 63 of the figure shows mixing flow-through in the center and vorticity being generated at the edge.

Figure 26A:
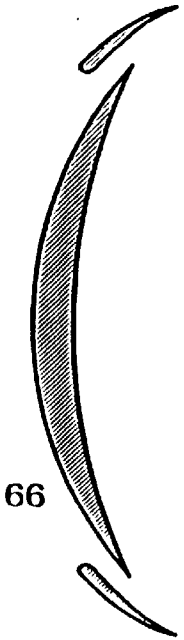
FIG. 26 is plan and section of a slotted DSVG.
Figure 26:
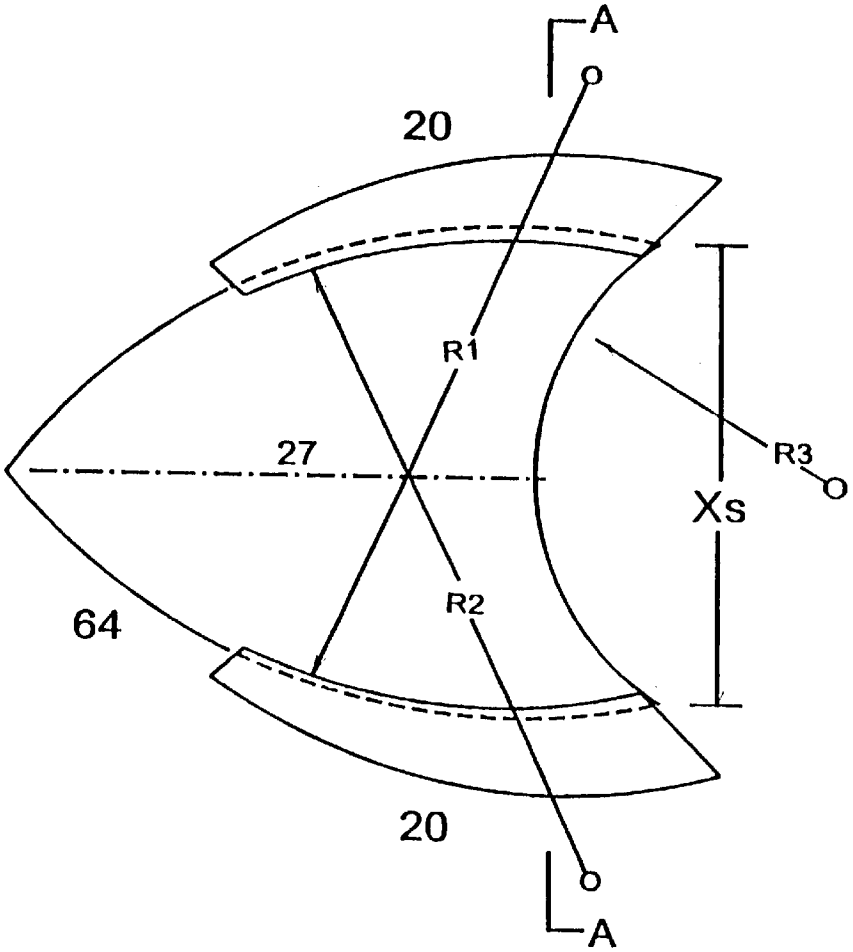
Figure 27A:
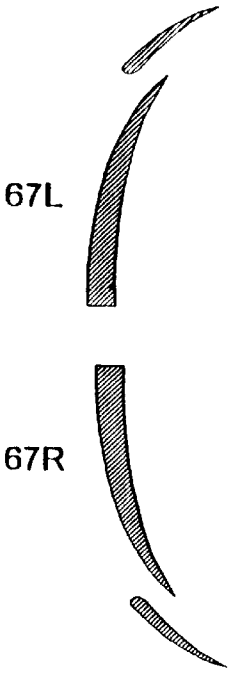
FIG. 27 is plan and section of a slotted SSVG.
Figure 27:
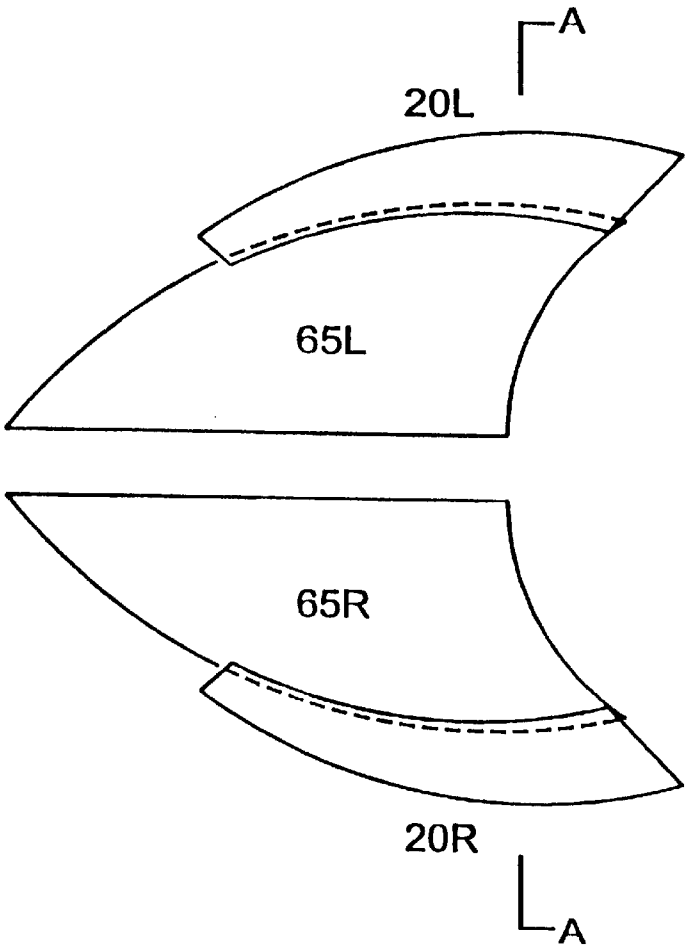

FIG. 26 is DSVG 64 and shown in section 66, with openings which allow streamwise flow-through. The slot between 64 and 20 mimics the slot of a high lift wing. The cross flow component is similar to that produced by a lifting body rather than a drag producing body. This has advantages when flow-through is desired without using essentially drag producing bodies. FIG. 27 shows the same arrangement for SSVG 65, and shown in section 67.

EXAMPLE 3: A SYSTEM FOR MITIGATING SCOUR AND DEBRIS DAMAGE

Figure 28A:
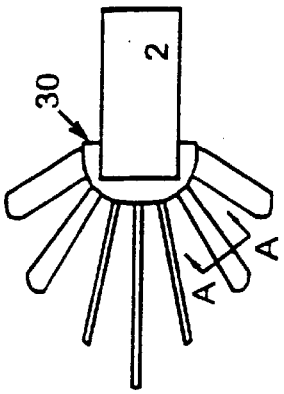
FIG. 28 illustrates the various elements functioning as a system to protect a structure from scour and debris impact.
Figure 28B:
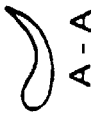
Figure 28:
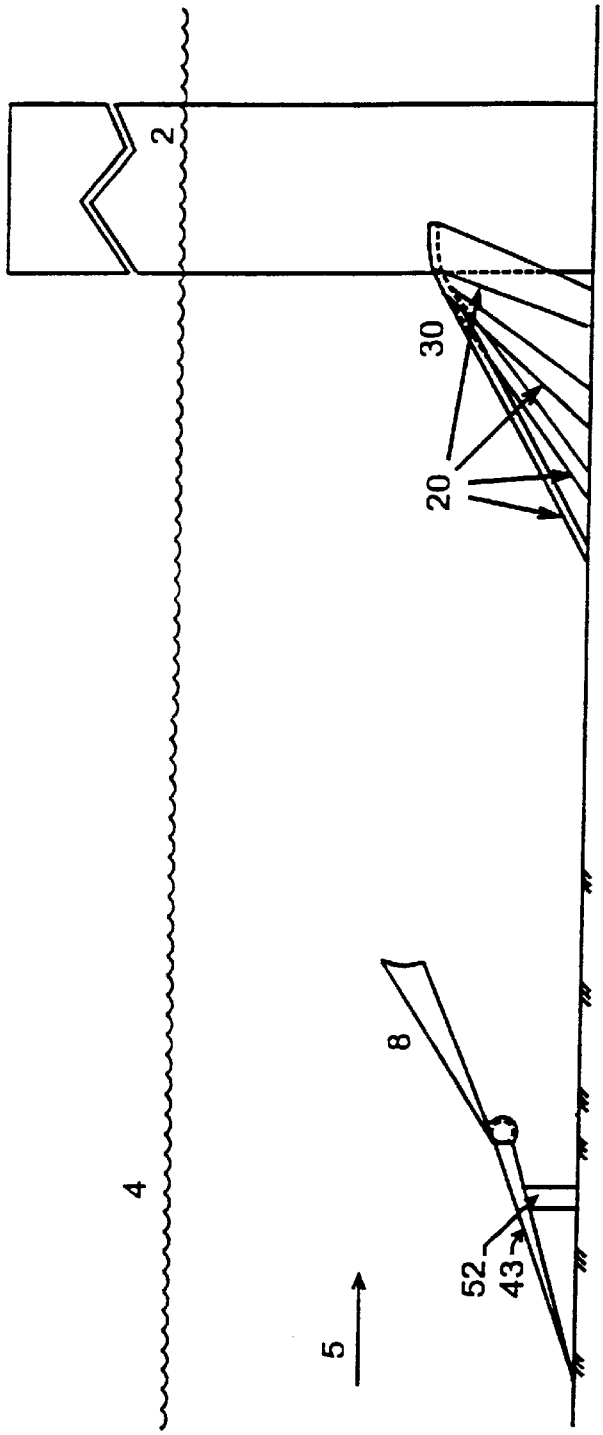

The operation of the above elements as a system is illustrated in FIG. 28 where there is significant cooperation between the system elements. The flow is shown approaching pier 2 in direction 5 in the side elevation. DSVG 8 is supported by a strut 52. This strut also supports a velocity defect generating grid 43. The grid 43 protects the base of the strut from scour. Scour conditions may be so severe that it is not possible to install strut 52 without protection by a device such as 43. The cooperative effect of 43 and 8 may be of vital importance.

The wake flow from 43 encounters the structure 30 affixed to the pier. Since the flow has been modified by 43, the ability of this structure to control local scour is greatly enhanced. At the same time the bed surrounding the pier and any existing rip-rap is also protected.

While the invention has been particularly shown and described with reference to a bridge in a stream for illustrative purposes, it will be appreciated by those skilled in the art that the present invention may be embodied in other specific forms without departing from its spirit and scope. The invention is not limited to the embodiments described herein, but may be modified within the scope of the claims.

We claim:

1. A device for directing the flow of buoyant contaminants in a stream, said stream having a surface and a stream bed, so as to reduce impact of said buoyant contaminants with at least one downstream structure, comprising one or more vortex generators for generating vortices in the placed so as to deflect said buoyant contaminants from a path which would otherwise have resulted in impact with said downstream structure stream.

2. A device as in claim 1 wherein said generators are streamwise vortex generators.

3. A device as in claim 1 wherein said generators are lifting bodies configured so as to produce lift when acted upon by the flow of said stream.

4. A device as in claim 1 wherein said generators are of arcuate lifting shape.

5. A device as in claim 1 wherein said device is placed sufficiently close to the surface of the stream to generate a streamwise vortex which affects the path of the flow of buoyant contaminants.

6. A device as in claim 1 wherein said device is placed sufficiently distant from the stream bed to avoid undesired disturbance of the stream bed.

7. A plurality of devices as in claim 1, aligned so that the streamwise vortices generated by each device in the alignment reinforce each other.

8. A device as in claim 1 wherein said generators are of Double Streamwise Vortex Generator (DSVG) configuration.

9. A device as in claim 1 wherein said device is placed so as to induce a vortex whose axis is essentially parallel to the flow of the stream, and which affects the flow of said buoyant contaminants.

10. A plurality of devices as in claim 1 wherein said generators are combined to form shapes with one or more Double Streamwise Vortex Generator or Single Streamwise Vortex Generator components.

11. A plurality of devices as in claim 1, offset from each other horizontally.

12. A device as in claim 11 wherein said generators are lifting bodies configured so as to produce lift when acted upon by the flow of said stream.

13. A device as in claim 1 wherein the flow of said buoyant contaminants is directed in a substantially horizontal direction.

14. A method for mitigating scour of an area of a stream bed near a structure located in said stream bed, comprising the steps of identifying the area to be protected, providing a device comprising a drag generating body having a "v-shaped" element, placing said device upstream from said area with the apex of said v-shaped element pointing upstream at a distance above the stream bed so as to reduce local scour and/or contraction scour without adversely affecting the streambed.

* * * * *